US007476820B2

(12) United States Patent
Aubert Capella

(10) Patent No.: US 7,476,820 B2
(45) Date of Patent: Jan. 13, 2009

(54) MULTI-FUNCTIONAL, FLUSH-FITTING ELECTRICAL MECHANISM

(75) Inventor: Joaquin Aubert Capella, Barcelona (ES)

(73) Assignee: Simon, S.A., Barcelona (ES)

( * ) Notice: Subject to any disclaimer, the term of this patent is extended or adjusted under 35 U.S.C. 154(b) by 0 days.

(21) Appl. No.: 11/566,089

(22) Filed: Dec. 1, 2006

(65) Prior Publication Data

US 2007/0125635 A1 Jun. 7, 2007

(30) Foreign Application Priority Data

Dec. 2, 2005 (ES) ..... 200502993

(51) Int. Cl.
*H01H 9/00* (2006.01)

(52) U.S. Cl. ..... 200/315; 200/314

(58) Field of Classification Search ..... 200/308–317, 200/339, 526, 553, 561, 433–438
See application file for complete search history.

(56) References Cited

U.S. PATENT DOCUMENTS

| | | | | |
|---|---|---|---|---|
| 6,255,610 | B1 * | 7/2001 | Botz et al. | 200/315 |
| 6,388,220 | B1 * | 5/2002 | Sasaki et al. | 200/537 |
| 6,608,253 | B1 * | 8/2003 | Rintz | 174/66 |
| 6,621,025 | B2 * | 9/2003 | Yei et al. | 200/315 |
| 6,666,707 | B2 * | 12/2003 | Moret Codina | 439/441 |
| 6,833,521 | B2 * | 12/2004 | Nishikawa | 200/339 |
| 6,940,029 | B1 * | 9/2005 | Wang et al. | 200/315 |
| 7,064,236 | B2 * | 6/2006 | Sundermann et al. | 564/355 |

(Continued)

FOREIGN PATENT DOCUMENTS

| | | |
|---|---|---|
| ES | 289715 | 3/1986 |

(Continued)

*Primary Examiner*—Michael A Friedhofer
*Assistant Examiner*—Lisa N Klaus
(74) *Attorney, Agent, or Firm*—Michael J. Striker

(57) ABSTRACT

Consisting of a casing (1), affixed to the supporting ring (56), equipped with an external operating key (16), whose hollow interior features interchangeable sets of contacts (22, 23, 24, 30, 32 and 34), in order to fulfill the following applications: single-pole switch, illuminated single-pole switch, single-pole switch with pilot light, bell-push, illuminated bell-push, two-way switch, illuminated two-way switch, two-way switch with pilot light, double-pole switch, double-pole switch with pilot light, crossover switch and illuminated crossover switch. The casing.(1), when it houses four contacts, features four lateral mounts (2), and for two or three contacts, three mounts (2). The rocker (13) transmits the pressure exerted on the key (16) to a swinging contact (21), and furthermore features two pivots (18) in the embodiment with two swinging contacts (21) and a single pivot (18) in that of a single swinging contact (21). The closing contact (23) of the crossover switch is obtained by means of soldering, being equipped with a separator (53) as protection against arcing. A system for fixing the contacts and a method for locking the fast connection keys (11) are foreseen, as is the particular arrangement of the pilot light, (5), whose contacts, by turning the same from one position to another, allow its function to be changed between that of pilot light and illumination; another characteristic being elements (51) and (52), which cause the light to be reflected so that it emerges through the visor (49), located in the key (16). The mechanism may be extracted from the front, with no need to remove the supporting ring (56).

7 Claims, 30 Drawing Sheets

U.S. PATENT DOCUMENTS

| | | | | |
|---|---|---|---|---|
| 7,105,762 | B1 * | 9/2006 | Lee | 200/449 |
| 2002/0074218 | A1 | 6/2002 | Moret Codina | |
| 2004/0200714 | A1 * | 10/2004 | Nishikawa | 200/553 |
| 2005/0006214 | A1 * | 1/2005 | Fujii | 200/339 |
| 2005/0006218 | A1 * | 1/2005 | Kwong | 200/553 |
| 2005/0173236 | A1 * | 8/2005 | Lai | 200/402 |
| 2006/0011460 | A1 * | 1/2006 | Hung | 200/315 |

FOREIGN PATENT DOCUMENTS

| | | |
|---|---|---|
| ES | 1 041 441 | 7/1999 |
| ES | 1 047 527 | 4/2001 |
| ES | 2 204 280 | 4/2004 |
| ES | 2 249 945 | 4/2006 |

* cited by examiner

Single-Pole Switch

Illuminated Bell-Push

Illuminated Single-Pole Switch

Two-Way Switch

Illuminated Two-Way Switch

Double-Pole Switch with Light

Crossover Switch

MULTI-FUNCTIONAL, FLUSH-FITTING ELECTRICAL MECHANISM

CROSS-REFERENCE TO RELATED APPLICATIONS:

This application claims priority under 35 U,S.C. 119(a)-(d) to Spanish Patent Application Number 200502993, filed Dec. 2, 2005.

BLACKGROUND OF THE INVENTION:

1. Field of the Invention The present of invention relates to a multifunctional electrical mechanism, designed for use in flush-fitting applications and in surface-mounted casting for the control and operation of low-voltage electrical installations in particular, characterized essentially due to its multi-functionality, consisting of its possible application to control and monitoring functions, optimizing its basic parts in accordance with the type and varying the arrangement of different combinations of contacts, with the aim of making possible the configurations use detailed below:

A single-pole switch, an illuminated single-pole switch, a switch with a pilot light, a bell-push, an illuminated bell-push, a two-way switch, an illuminated two-way switch, a two-way switch with a pilot light, a double-pole switch, a double-pole switch with a pilot light, a crossover switch, an illuminated crossover switch; a total of twelve configurations.

The mechanism which is the object of this invention is characterized also because of the design and the concept of the body or casing, shown in the embodiments with four mounts for the housing of terminals (normal type) or three mounts (reduced type), an embodiment which permits considerable savings of material.

Another essential characteristic of the mechanism disclosed is the type of rocker, designed in order to transmit the action exerted on-the external key to the swinging contact inside the mechanism, also made with two pivots in its four-contact application, or with a single pivot in its three-contact embodiment.

The design of the two-way switches, modified in the place where the mobile contact will be located, is an essential characteristic of the invention, as is that of the crossover switches, whose assembly, soldered instead of riveted, and provided with an insulating separation in order to prevent electric arcing is to be noted, as is its anchorage.

Another essential characteristic of the mechanism disclosed is the arrangement of the contacts, with their fixing system.

The method of carrying out the connection, which may be by means of fast connection or by screws, presents a series of innovations which are essential characteristics of this invention.

This invention is likewise characterized by the particular disposition of the pilot light whose function, by means of a simple turning action, changes from illumination to pilot light, on changing the contacts on which said pilot light bears.

Finally, an essential characteristic of the electrical mechanism which is the object of this invention is the method of extracting the main part of the mechanism from its supporting ring, by means of a simple application of pressure with the help of an auxiliary tool, with no need to dismantle any part of the assembly.

2. DESCRIPTION OF RELATED ART

In the techniques currently used to carry out low-voltage installations, and particularly the flush-mounted installations used in homes or in small industries or businesses, as in small offices, on condition that it be in compliance with current legislation, the preparation and use of mechanisms which allow an immediate interchangeability of some of the elements of which it is comprised, for use in different applications or configurations, is of the greatest importance, due to the savings of all types that it represents.

Thus, the quantity of components to be manufactured is considerably reduced, with the resulting savings in manufacture, in stocks and in storage, likewise the reduction in the labor to be employed, both in the manufacture and in the installation by specialists.

As a reference to the current state of the art, one may quote patent P200301301 (1), which relates to improvements made on low-voltage electrical devices, intended for various configurations; the patent of invention P200201014 (5), which relates to a mechanism with a rocking key, flush-mounted; the utility models MU 289.715, relating to multi-purpose electrical mechanisms; MU 9802516, likewise relating to operation and monitoring electrical devices; and U 200002681, which relates to fast-connection devices.

The characteristics of all these patents and utility models though being sufficient for the particular cases to which they relate, do not display the characteristic innovations encompassed by the patent of invention with which we are concerned.

BRIEF SUMMARY OF THE INVENTION:

Therefore, the multi-functional electrical mechanism which is the object of this invention is comprised, basically, of a basic central assembly, comprised of the body or casing, on which will be located the rocker which makes possible the transmission of the operating movement of the swinging contacts, due to the pressure exerted on the external rocking key, said swinging contacts, together with the other contacts, these being variable in accordance with the desired configuration, being located in the interior of the casing.

The rocker has two different embodiments, with two pivots or with a single pivot, both models incorporating fins arranged in order to protect against electric shock.

The rocker with two pivots shall be used in the applications of double-pole switch, double-pole switch with pilot light, crossover switch, and illuminated crossover switch.

The rocker with a single pivot, the rest of the same being identical to that mentioned above, shall be used in the applications of single-pole switch, illuminated single-pole switch, single-pole switch with pilot light, bell-push, illuminated bell-push, two-way switch and illuminated two-way switch.

As has been mentioned above, the casing or body of the mechanism presents two embodiments:

The casing which can house four contacts, considered to be the normal type, equipped with four mounts and used for the applications of two-way switch with pilot light, double-pole switch, double-pole switch with pilot light, crossover switch and illuminated crossover switch.

The casing which can house three contacts, considered to be the reduced type, on being equipped with only three mounts offers a saving in material and assembly of approximately one-fifth of the total, and is used in the applications of single-pole switch, illuminated single-pole switch, single-pole switch with pilot light, bell-push, illuminated bell-push, two-way switch and illuminated two-way switch.

The applications of two-way switch and crossover switch present modifications in their mobile contacts: the two-way switch featuring it in an L-shape in order to reach half-way between the two fixed contacts, and in the crossover switch it is assembled by soldering, where assembly has usually been by riveting. Thus, a fixed contact is soldered to an extension, achieving in this way the desired shape.

Furthermore, it presents the arrangement of a separating insulation positioned between the contacts, this being necessary due to the absence of the minimum distance between these; it also presents the means of anchoring the same.

It should be noted that at the lower part of the contacts there is a retaining means which fixes the contact when located in its correct position, which prevents the contact from accidentally leaving this correct position while the pilot light is being installed.

The insertion of the pilot light is central, it only being necessary to turn the position of the same, so that it bears on different contacts, when it is desired to change its function to pilot light or illumination.

Connection, which may be carried out by fast connection or by screws, modifies to advantage the flange retaining it to the plastic base of the connection, which will acquire a dovetail shape, replacing any retaining cover.

The characteristics of the connection contact allow this and the contact to be fitted at the same time during assembly, being an independent assembly.

The key to assist fast connection shall present two variants:

A single key per terminal, with a single pressure for both cable inlets and which, by means of its nose-shape, acts as a guide so that the cable will not stray; and a split key, facilitating individual pressure on the two cable inlets, maintaining the nose-shape in order to guide the cables.

The casing shall be equipped with a protruding rib which will act as a lock in order to prevent the fast connection key from lifting, once it has been lowered from its initial position.

The main part of the mechanism shall be removed from the, front, with regard to the supporting ring, exerting pressure by means of an auxiliary tool, for example a simple screwdriver, on the locking tab which anchors the main part onto the aforementioned supporting ring, it thus being possible to remove it immediately.

Finally to be noted is the particular arrangement of the lamp and the emergence of light through the key, whose visor is set to one side of the central axis, due to the shape adopted by the internal part of the rocker itself.

BRIEF DESCRIPTION OF THE DRAWINGS:

With the aim of clearly detailing the characteristics of each of the components of the mechanism which is the object of this invention, attached to this report will be found a series of drawings in which, as a non-limitative example, a practical embodiment of the mechanism disclosed is portrayed, in its different applications.

In said drawings,

FIG. 61 shows the position of the pilot lamp in the configuration of illuminated switch/bell-push/two-way switch.

FIG. 62, in the configuration of switch with pilot light.

FIG. 63, in the configuration of two-way switch with pilot light.

FIG. 64, in the configuration of illuminated crossover switch.

FIG. 65, in the configuration of double-pole switch with pilot light.

FIG. 74 portrays the start of the operation, indicating the area of the mechanism to which the auxiliary tool is to be applied.

FIG. 75 portrays, in greater detail, the location where the auxiliary tool will be applied to the mechanism.

FIG. 76 is a larger-scale detail of the previous figure.

FIG. 77 shows the tool already in place and the commencement of its action on the locking tab.

FIG. 78 is a larger-scale detail of the previous figure.

FIG. 79 shows the action of separating the locking tab by means of the auxiliary tool.

FIG. 80 is a larger-scale detail of the previous figure.

FIG. 81 shows the separating action of the tool, inserted further into the edge of the mechanism.

FIG. 82 is a larger-scale detail of the previous figure.

FIG. 83 portrays the commencement of the egress of the locking tab from the location where it was lodged.

FIG. 84 is a larger-scale detail of the previous figure.

FIG. 85 is the last view of freeing the tab in order to allow the removal of the main part of the mechanism.

Finally, FIG. 86 is a larger-scale detail of the previous figure.

DETAILED DESCRIPTION OF THE INVENTION

Figure 1:
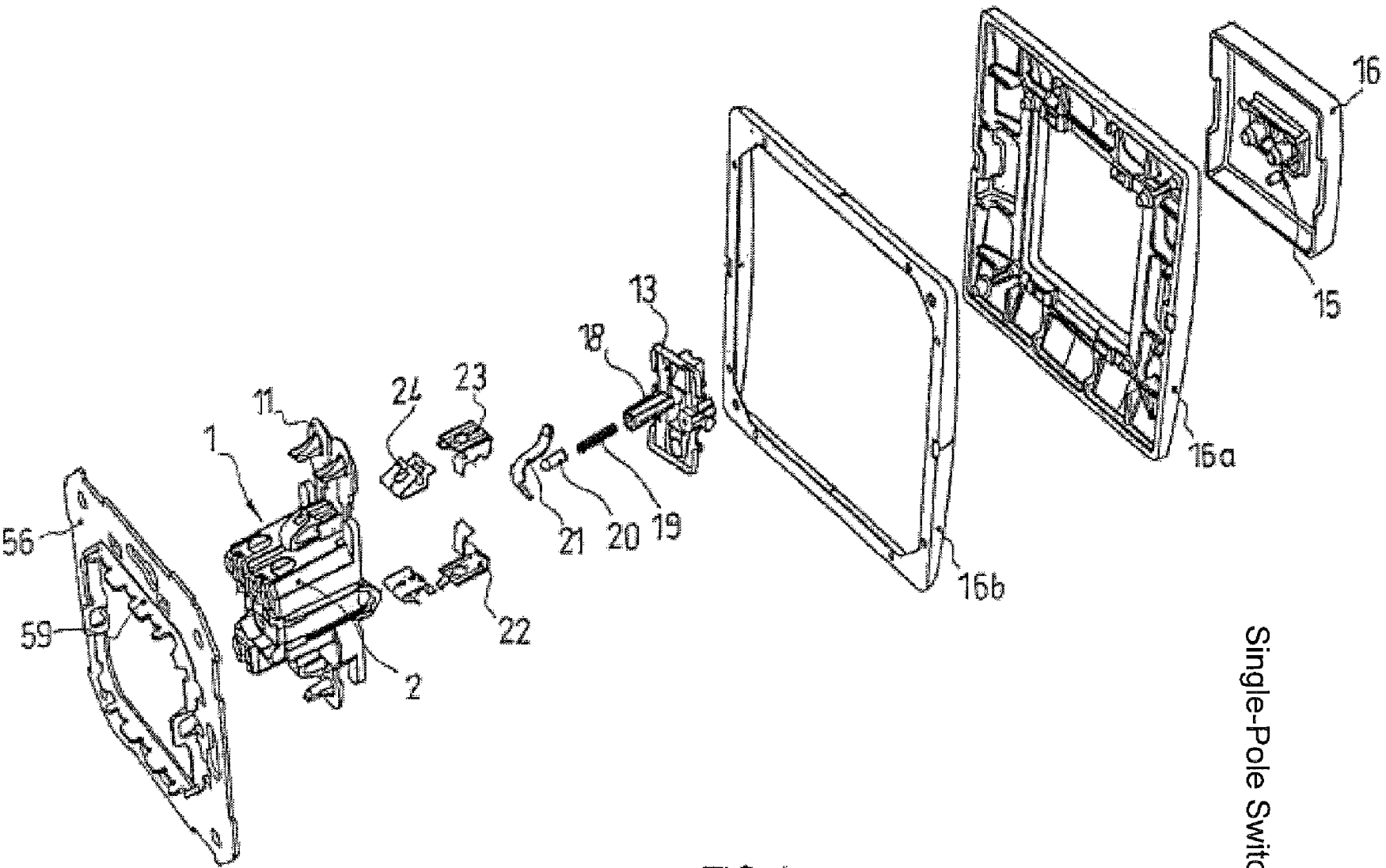
FIG. 1 is an exploded view in perspective of the mechanism corresponding to the configuration, of the single-pole switch, including in the drawing the operating key, the external decorative trim and the fixing ring, elements which are not portrayed in the following drawings.
Figure 2:
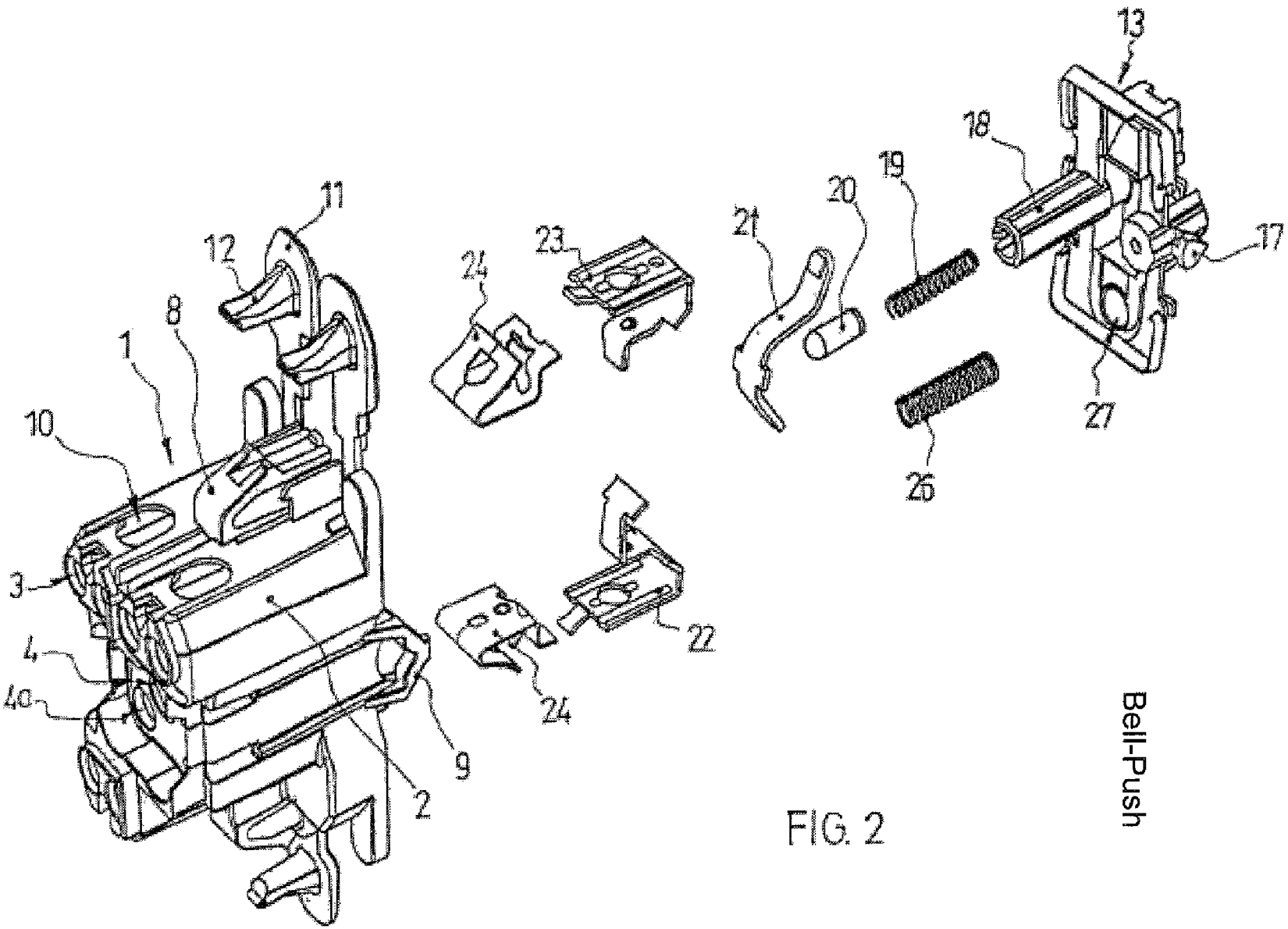
FIG. 2 is also an exploded view in perspective, similar to the previous figure, of the mechanism corresponding to the configuration of the bell-push.
Figure 3:
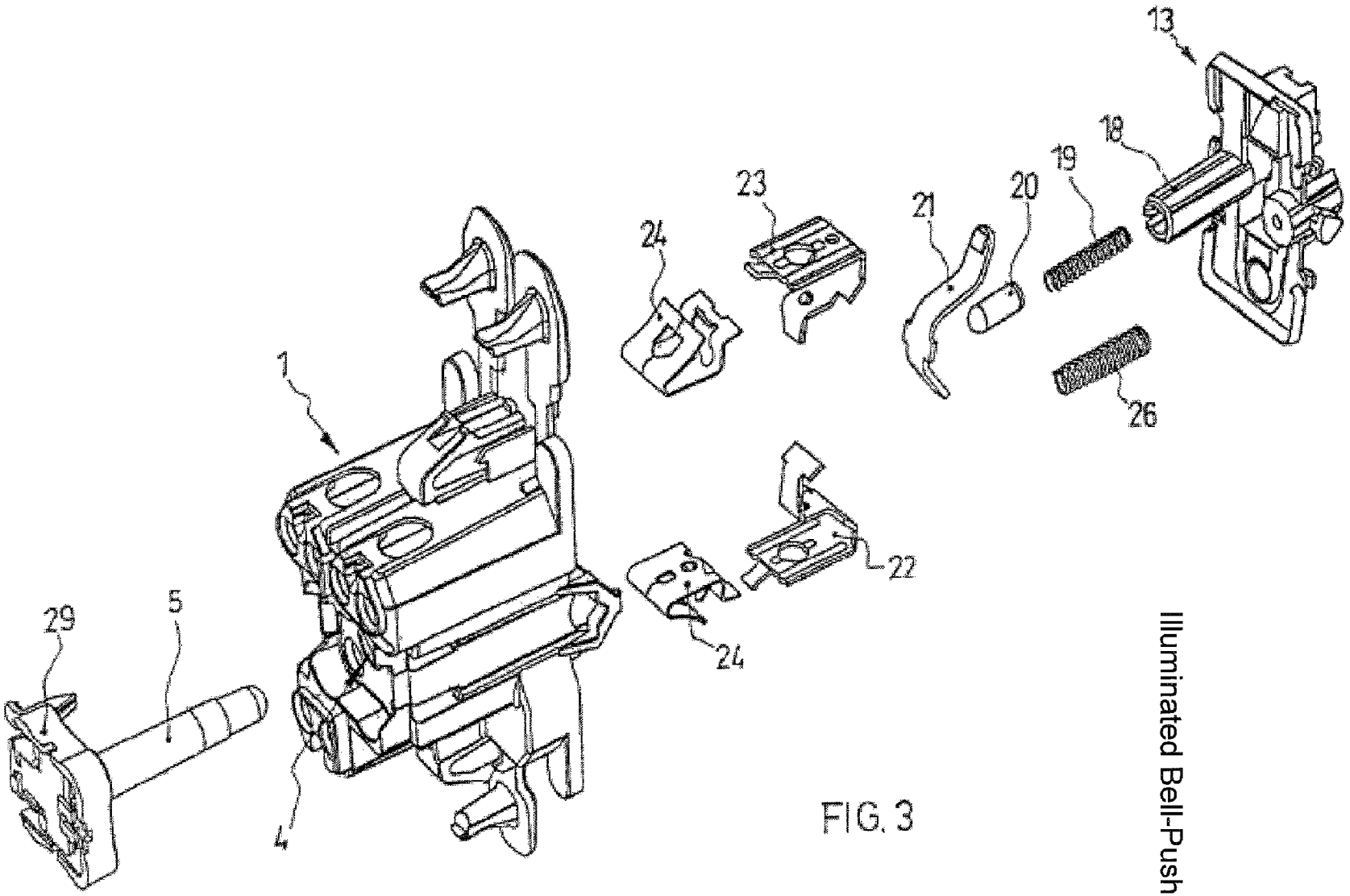
FIG. 3, following the development of the two previous figures, portrays an exploded view in perspective of the mechanism in its configuration of the illuminated bell-push.

In accordance with the drawings disclosed above, the multi-functional flush-fitting electrical mechanism which is the object of this patent of invention is comprised of the body or casing (1) formed by a hollow block, whose shape and outline is slightly like a truncated pyramid, provided with four thicker parts at its sides, as mounts (2). The elements of the mechanism for the connection of the cables to the same, to be disclosed below, will be located in these.

For this reason, each of the lateral mounts (2) is provided with two circular holes (3) in its lower side, for the passage of said cables.

In the embodiment of the mechanism with four contacts, the casing (1*a*) will be provided with four lateral mounts (2), as portrayed in FIGS. 9 to 15, whereas in the embodiment with three contacts, the casing (1) will be equipped with only three mounts (2), as shown in FIGS. 1 to 8 and 16 to 18, a practical embodiment which represents a considerable saving in material.

The casing (1) is equipped with a central orifice (4) located in the base of the same, through which the lamp (5) may be easily inserted, and likewise, with the openings for the positioning of the dovetail-shaped flanges (7) of the contacts located therein, tabs which, being bent (7*a*) once positioned, will prevent any movement of said contacts.

The casing is also provided with lateral tabs (8) for anchoring and fixing the same, and lateral flanges (9) with triangular cavities on which the rocker (13) will tilt; also four orifices (10), two at the lower part of each side, to allow the insertion of the protruding lugs (12) of the fast connection keys (11). These keys are located, prior to the installation of the casing, at the same level and as a prolongation of the upper surface of the casing itself, as portrayed in FIGS. 1 to 12.

It is equipped with a rocker mechanism (13), which is positioned on the casing (1), comprised of an appreciably curved rectangular plate:. (13*a*), on whose upper surface there are two symmetrical cavities (14) for the insertion and locking of the corresponding cylindrical pivots (15) with which the external key (16) is equipped in order to lock the same onto the rocker (13), and a third, rectangular-shaped, separate cavity through which the beam of the pilot light will rise towards the visor (49) of the key (16).

The rocker is equipped, at its sides, with two lateral supports, of a triangular profile (17), to provide the rocking action when it is resting in the triangular cavities of the flanges (9) of the casing (1).

The lower surface of the rocker (13) is equipped with hollow pivots (18), inside which are lodged the cylindrical springs (19) which will press the round-headed cylindrical lugs (20) against the swinging contacts (21) (21*a*) (21*b*).

These lugs, located inside the hollow pivot (18), are also hollow, the spring (19) being lodged inside them.

In the configurations of the mechanism for the double-pole switch, double-pole switch with pilot light, crossover switch, illuminated crossover switch, the rocker (13) will be equipped with two hollow pivots (18), as portrayed in FIGS. 9 to 12 and 19 to 22.

In the configurations of the mechanism for the single-pole switch, illuminated single-pole switch, single-pole switch with pilot light, bell-push, illuminated bell-push, two-way switch, illuminated two-way switch and two-way switch with pilot light, the rocker (13) will be equipped with a single hollow-pivot (18), as portrayed in FIGS. 1 to 8 and 23 to 26.

The assembly of rocker (13) and casing (1) being thus arranged, the cylindrical lug (20), pushed by the action of the external key (16), through-the rocker (13) and the cylindrical spring (19) will press on the swinging contact (21).

An essential characteristic of this invention, as has been mentioned above, is that the contact assemblies are easily interchangeable, in order to allow a different use of the mechanism, in a different configuration.

Figure 27:
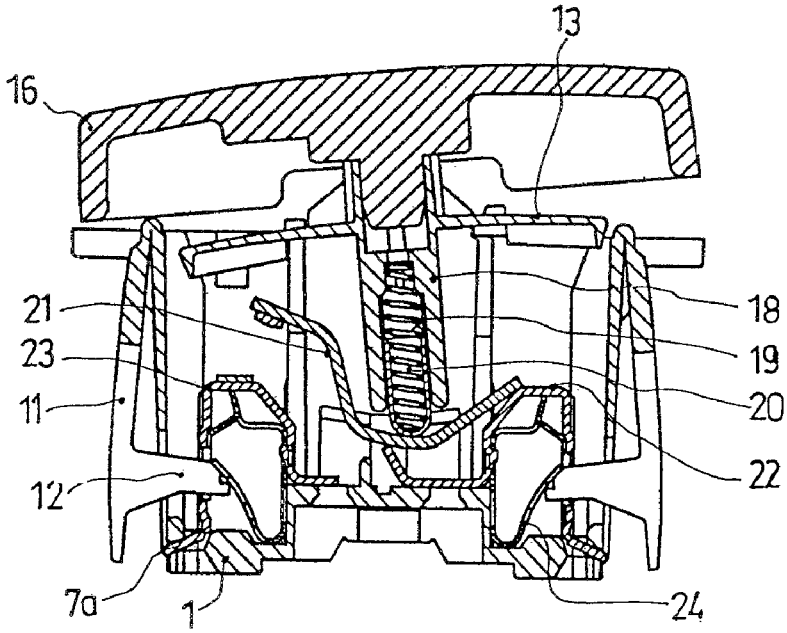
FIG. 27 is a sectional view of the single-pole switch and of the bell-push, taken through the central plane of the contacts.
Figure 28:
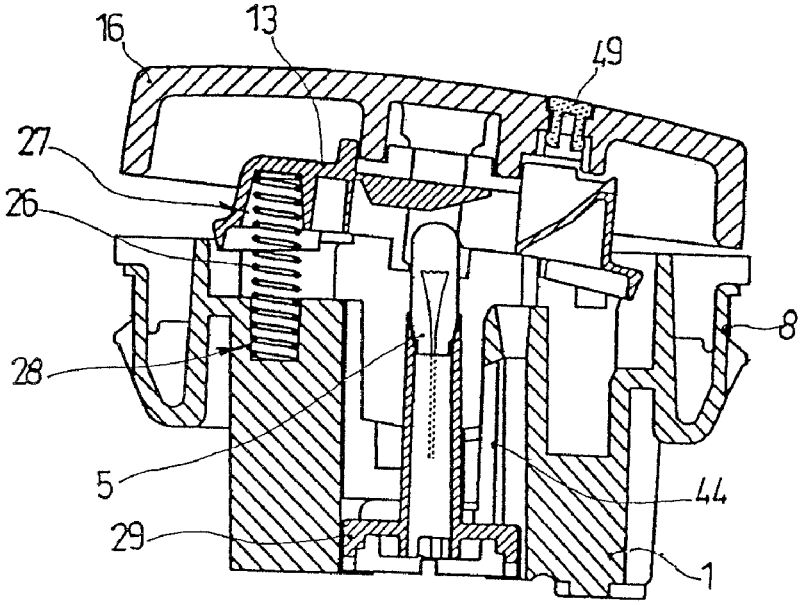
FIG. 28 is a sectional view of the illuminated bell-push, taken through the central plane of the mechanism.

In the configuration as a single-pole switch, in accordance with FIGS. 1, 27, 29 and 30, the mechanism is provided with the swinging contact (21), which rocks on the internal edge (22*a*) of the contact base (22), having a closing contact (23) opposite this, and also the two connection contacts (24), located in the internal region of the respective closing contacts (23) and contact base (22), as portrayed in FIG. 27.

The contact base (22) features a lower horizontal section (46) for affixing the same, and the dovetail-shaped flange (7). In turn, the closing contact (23) has an identical flange (7) and lower horizontal section (47) for its affixing.

At one end of the swinging contact (21), as on the upper part of the closing contact, contact buttons (25) are attached.

In the configuration as a bell-push, in accordance with FIGS. 2, 27, 29 and 30, it features the swinging contact (21), the contact base (22), on whose edge (22*a*) it will rest for the rocking motion, and the closing contact (23), together with the connection contacts (24).

This configuration is equipped with the cylindrical spring (26), whose upper end is lodged in the cavity (27) of the lower surface of the rocker (13), while its other end is lodged inside the orifice (28) with which the casing (1) is provided on one of its sides.

The function of this spring (26) is to cause the external key (16) and the rocker (13) to return to its initial non-activated position, when the force applied on the key (16) by the user ceases.

In the configuration as an illuminated bell-push, in accordance with FIGS. 3, 27, 28, 29 and 30, it features the swinging contact (21), the contact base (22), the closing contact (23), the connection contacts (24) and the cylindrical return spring (26), and with the particular purpose which is evident, the lamp (5), inserted through the central orifice (4) of the lower part of the casing (1).

This lamp is installed on the base, and equipped with a series of contacts, whose purpose will be disclosed below, and which allow the connection, appropriate in this configuration, for the lamp to be used for illumination.

Figure 4:
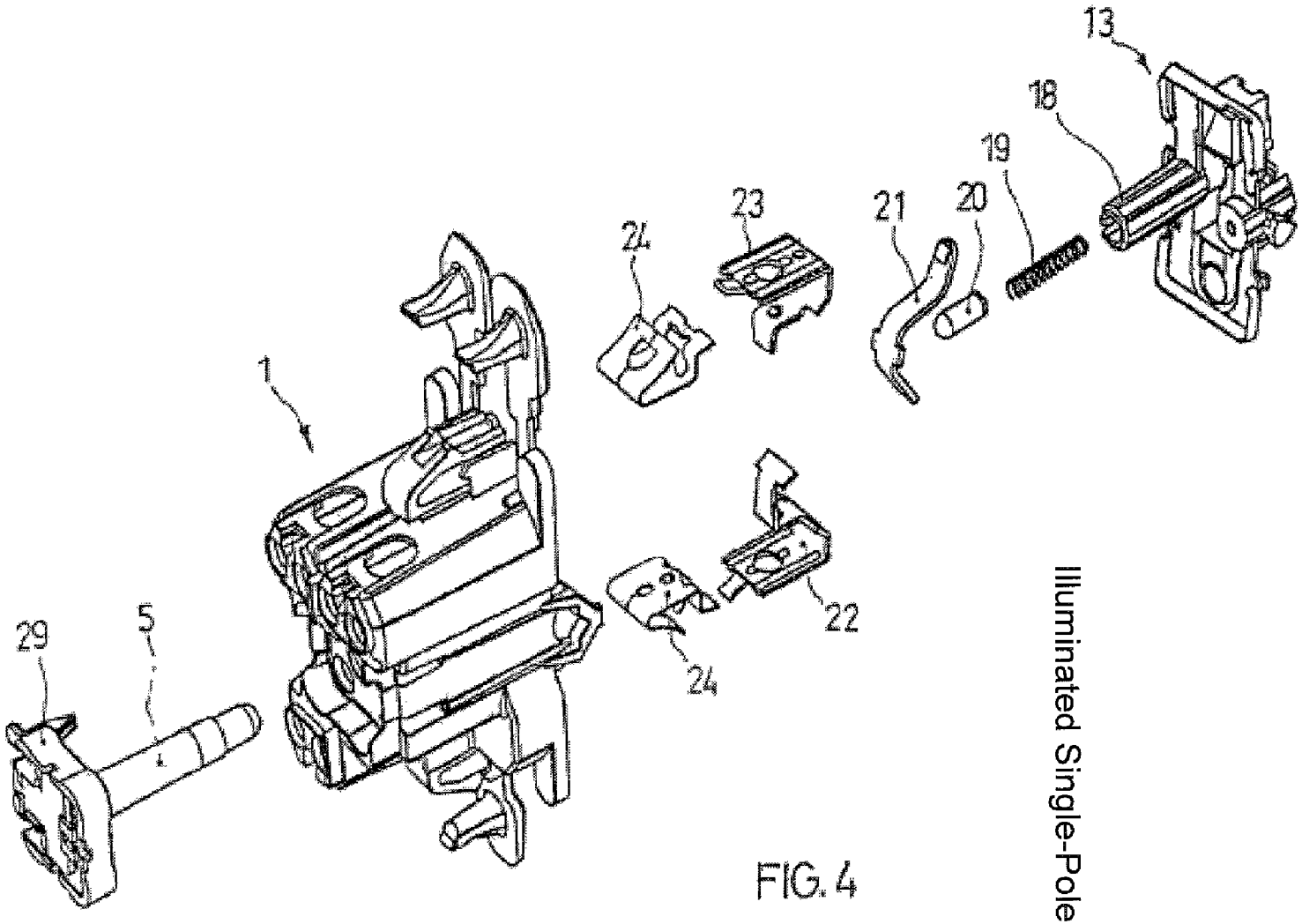
FIG. 4 portrays an exploded view in perspective of the mechanism in its configuration of the illuminated single-pole switch.
Figure 5:
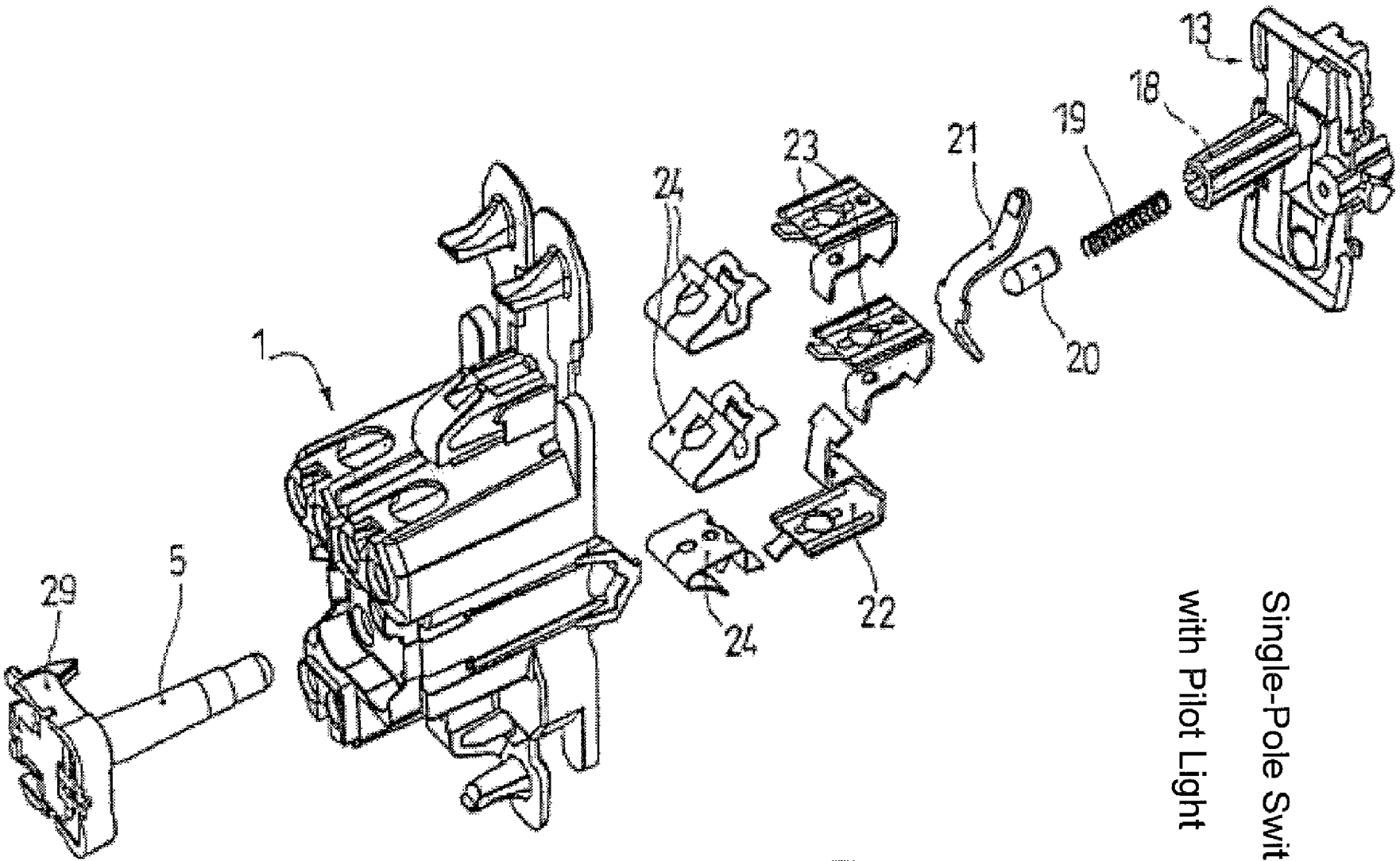
FIG. 5 portrays an exploded view in perspective of the mechanism in its configuration of the single-pole switch with pilot light.
Figure 6:
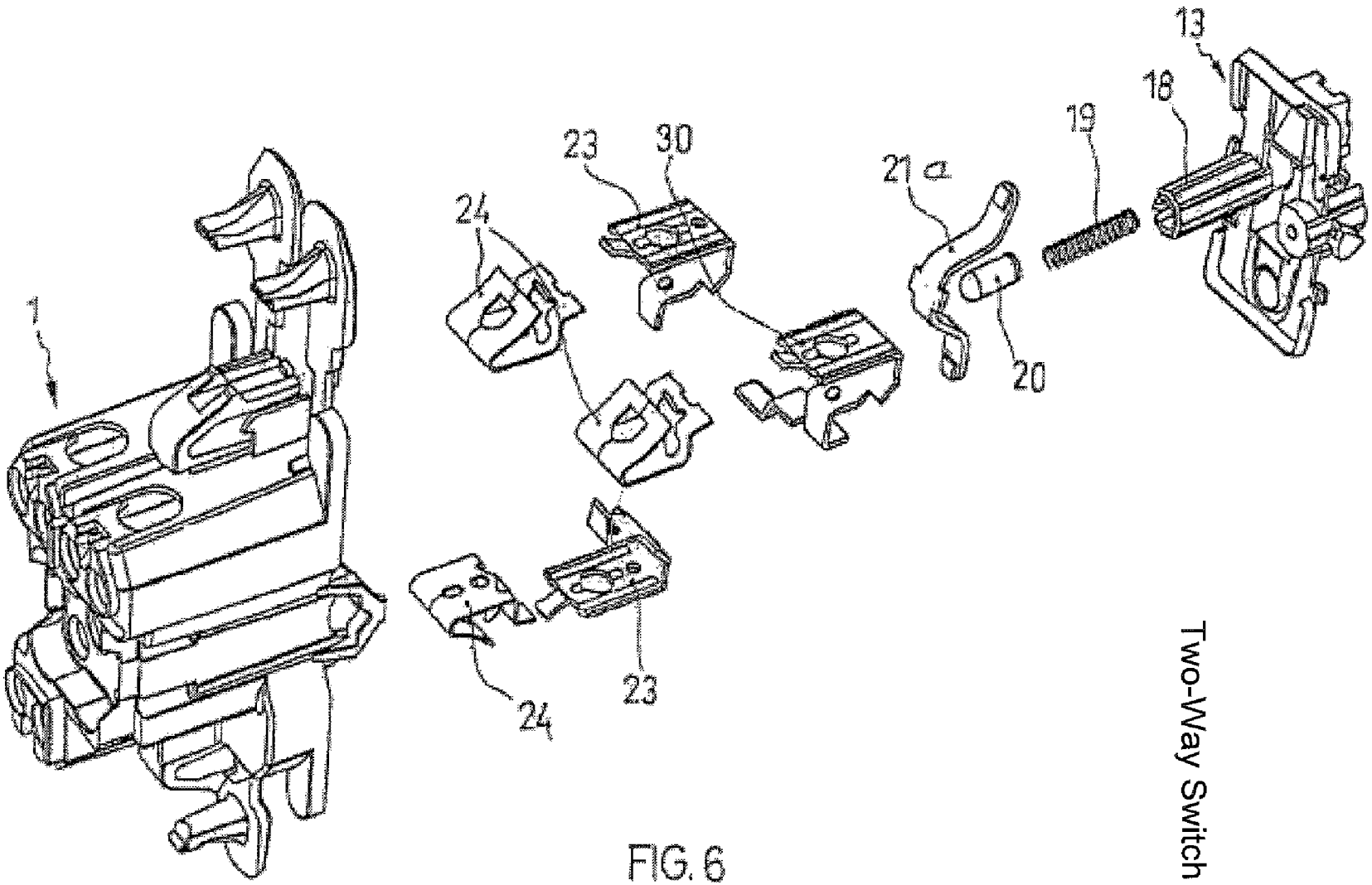
FIG. 6 portrays an exploded view in perspective of the mechanism in its configuration of the two-way switch.
Figure 7:
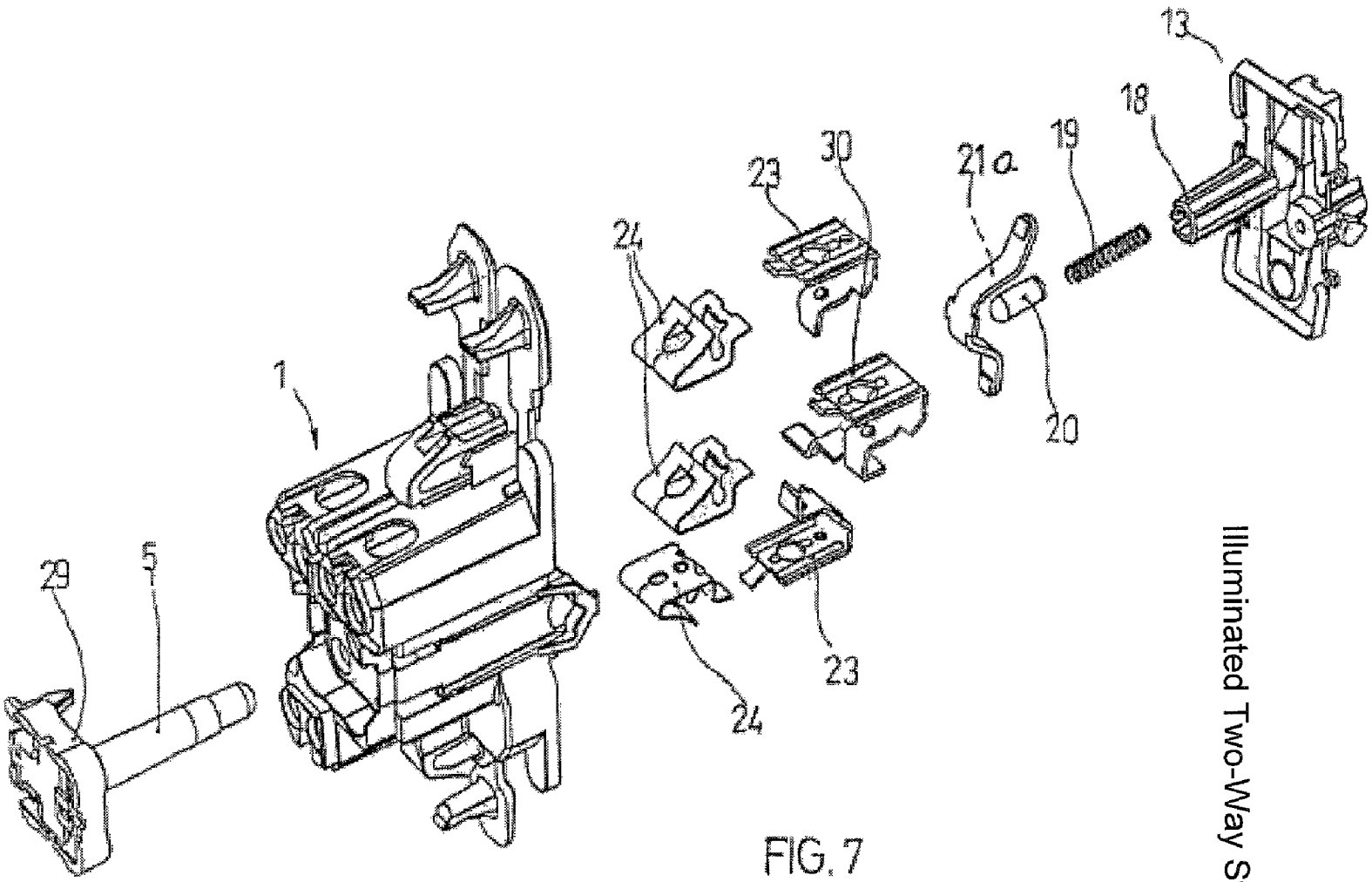
FIG. 7 portrays an exploded view in perspective of the mechanism in its configuration of the illuminated two-way switch.
Figure 8:
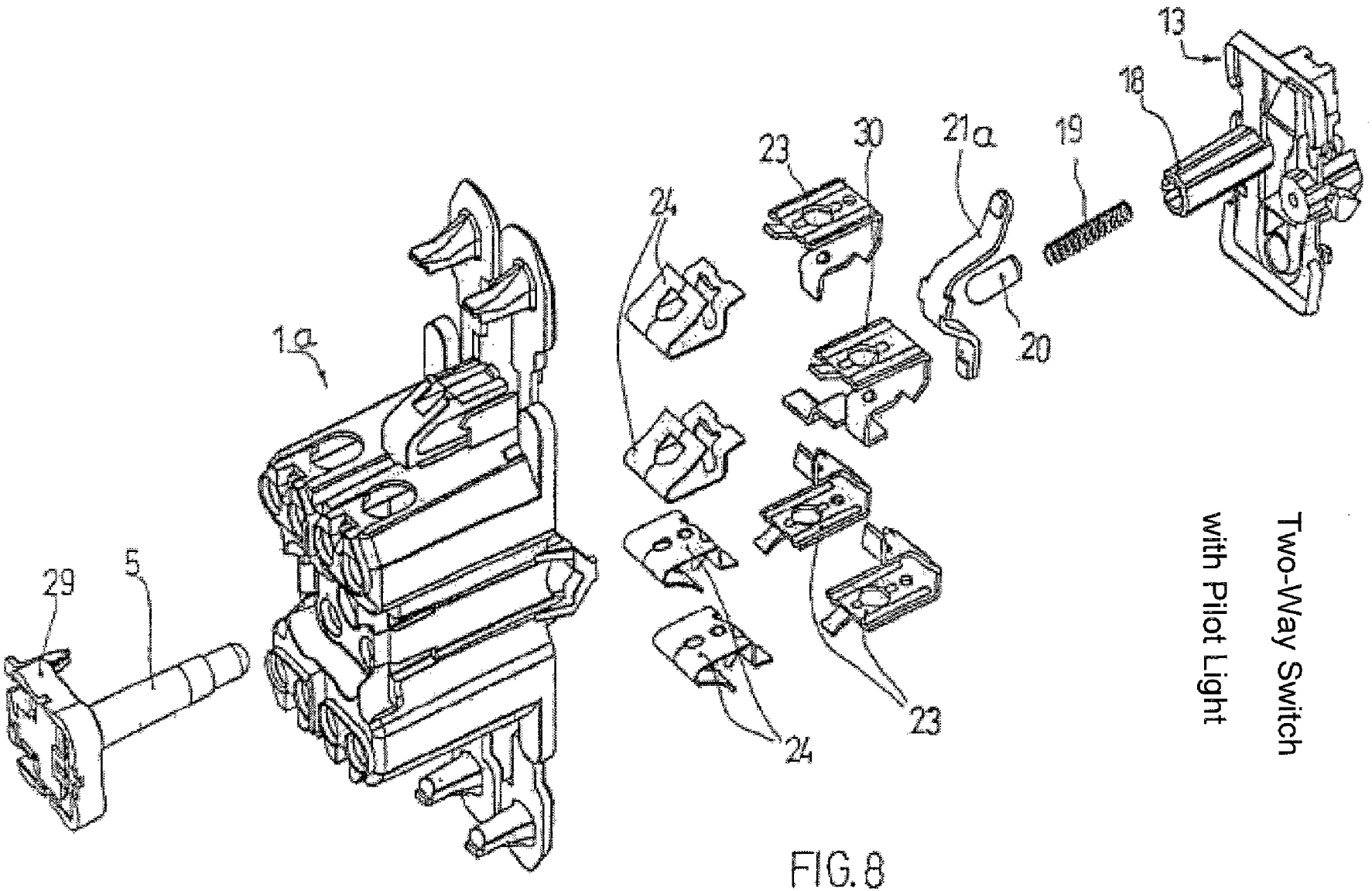
FIG. 8 portrays an exploded view in perspective of the mechanism in its configuration of the two-way switch with pilot light.
Figure 29:
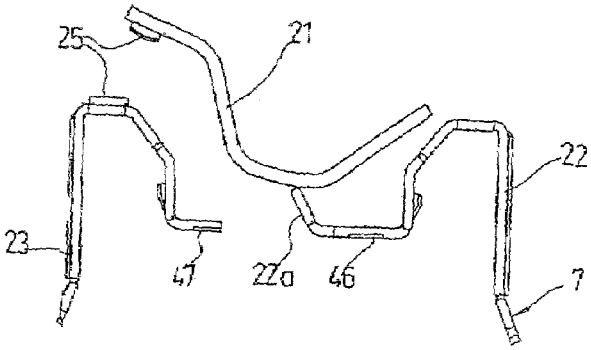
FIG. 29 is a profile view of the set of contacts of the bell-push/switch.
Figure 30:
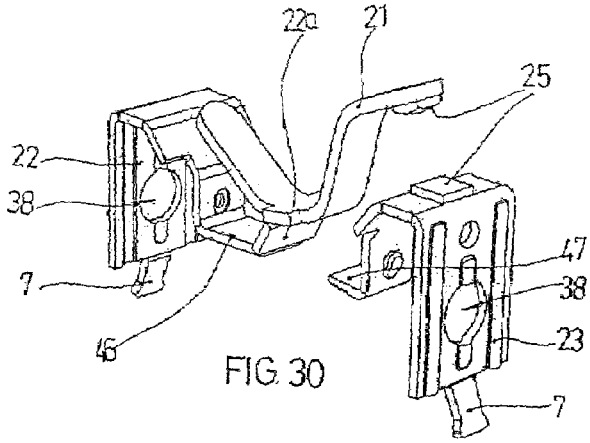
FIG. 30 is a view in perspective of the set of contacts in the previous figure, but seen from the other side.
Figure 31:
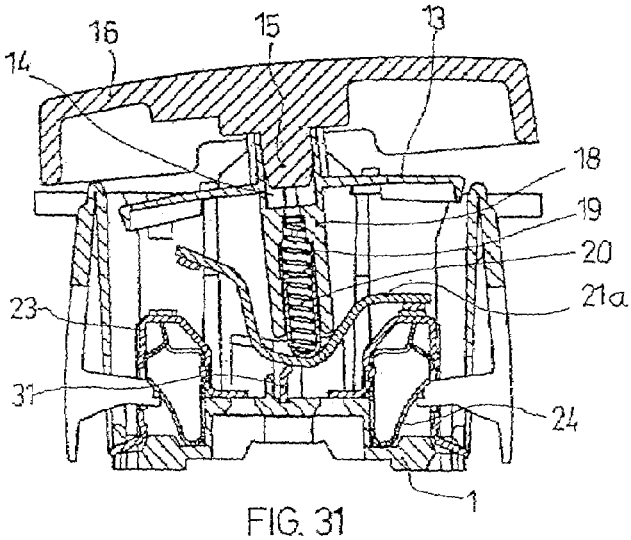
FIG. 31 is a sectional view, on the plane corresponding to the contacts, of the two-way switch mechanism.
Figure 32:
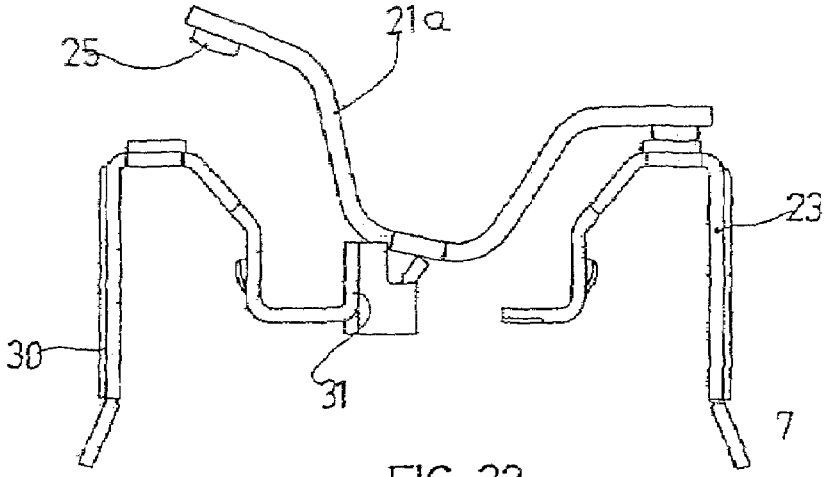
FIG. 32 is a profile view of the set of contacts of the two-way switch.
Figure 33:
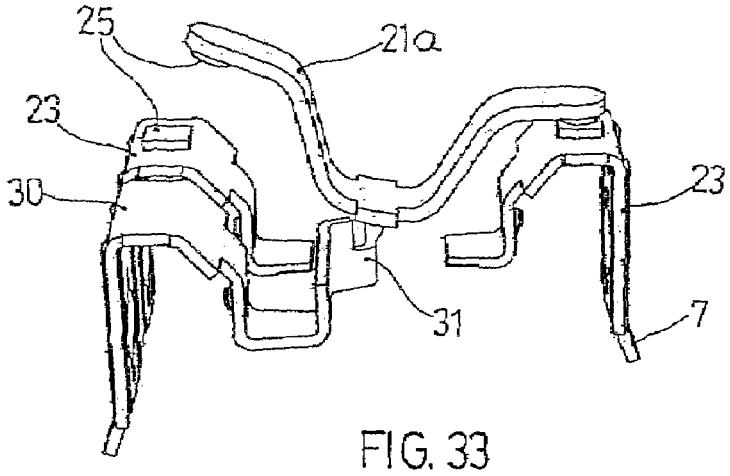
FIG. 33 is a view in perspective of said contacts, in the position portrayed in the previous figure.
Figure 34:
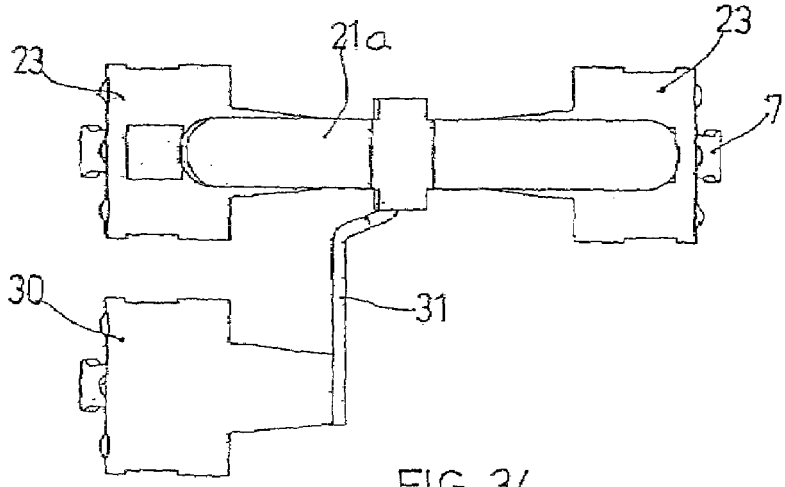
FIG. 34 is a plan view corresponding to the set of contacts in the two previous figures.
Figure 35:
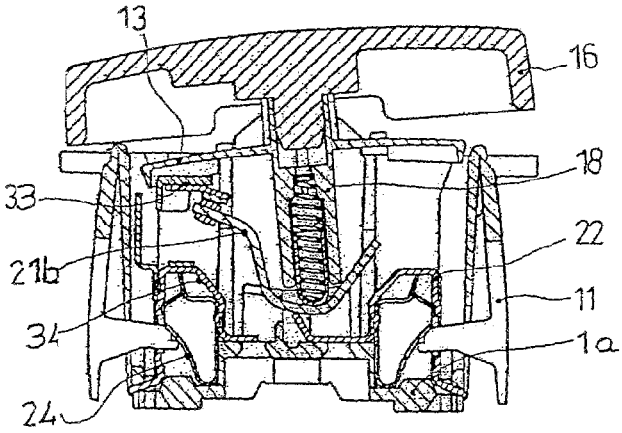
FIG. 35 is a sectional view, on the plane corresponding to the centre of a contact, of a crossover switch.
Figure 36:
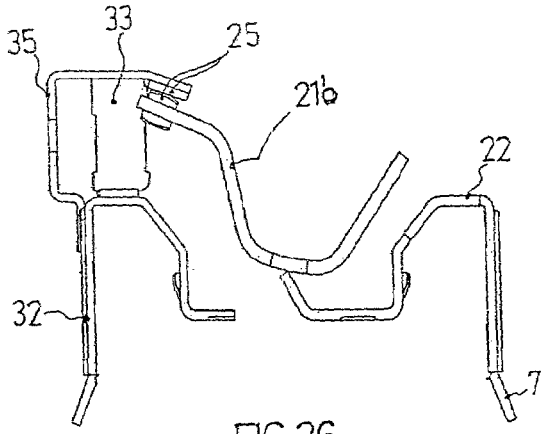
FIG. 36 is a profile view of the set of contacts of the crossover switch.

In the configuration as an illuminated single-pole switch, in accordance with FIGS. 4, 29 and 30, it features identical contacts to those of the single-pole switch (the swinging contact (21), the contact base (22), the closing contact (23) and the connection contacts (24)) with the addition of the lamp (5) installed on its base (29), on which the different contacts will be arranged so that said lamp will operate as illumination.

In the configuration as a single-pole-switch with pilot light, it will be provided with the swinging contact (21), the contact base; (22), the closing contact (23) and the connection contacts (24), together with a second closing contact (23*a*) as portrayed in FIG. 5, which will be equipped with its corresponding connection contact (24*a*), for the connection of the lamp (5), installed on the base (29), and equipped with contacts arranged for the correct operation of said lamp as a pilot light.

In the configuration as a two-way switch, as portrayed in FIGS. 6, 31 to 34, the mechanism is provided with the swinging contact (21*a*), and the contact base (30), different from those mentioned above, equipped with a changeover flange (31), on whose end the contact (21*a*) rocks, so that its two ends, equipped with contact buttons (25), connect alternately with the two closing contacts (23), located one opposite the other.

This configuration has three connection contacts (24), located within the space demarcated by the aforementioned contacts (23) and (30).

The mechanism presented as an illuminated two-way switch, in accordance with FIGS. 7 and 32 to 34, features the same contacts as the two-way switch: the swinging contact (21*a*), the contact base (30), two closing contacts (23) and three connection contacts (24), together with the lamp (5), installed on the base (29), whose contacts are positioned in order to fulfill the particular function of illumination.

In the configuration as a two-way switch with pilot light, as portrayed in FIGS. 8, 32, 33 and 34, the mechanism is provided with the swinging contact (21*a*), the contact base (30), with its changeover flange (31), three closing contacts (23) and four connection contacts (24), the swinging contact (21*a*)

being equipped with two contact buttons (25), as are the three closing contacts (23), being equipped with a lamp (5), installed on its base (29), whose contacts are positioned in order to fulfill the particular function of pilot light.

Figure 9:
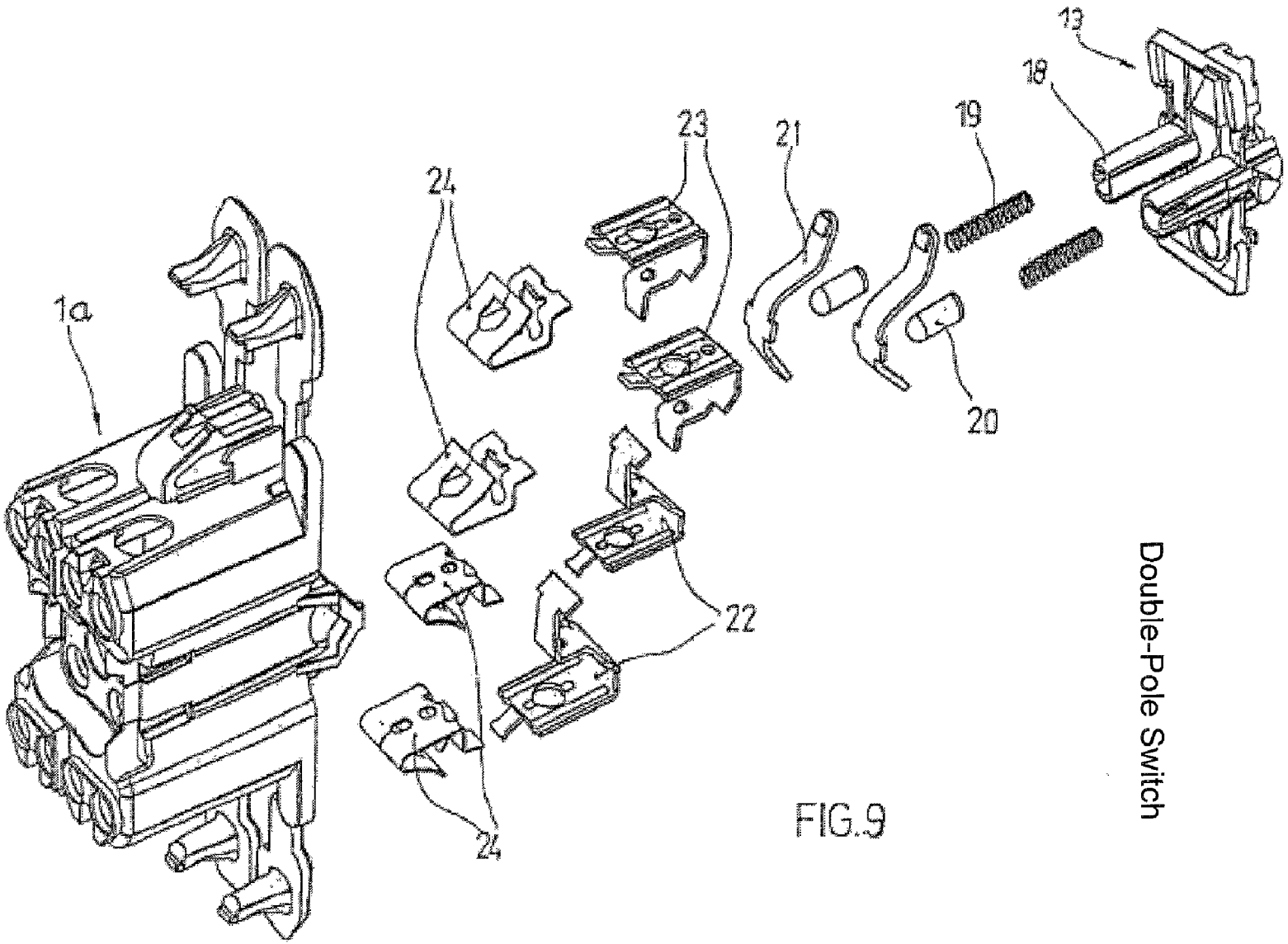
FIG. 9 portrays an exploded view in perspective of the mechanism in its configuration of the double-pole switch.

In the configuration as a double-pole switch, as portrayed in FIG. 9, the mechanism presents two swinging contacts (21), which rest on their respective contact bases (22); two closing contacts (23) and four connection contacts (24), thus completing the mechanism, it having two swinging contacts (21), and for the correct operation of the same, two cylindrical lugs (20), together with their corresponding cylindrical springs (19), located in the hollow pivots (18) of the rocker (13).

Figure 10:
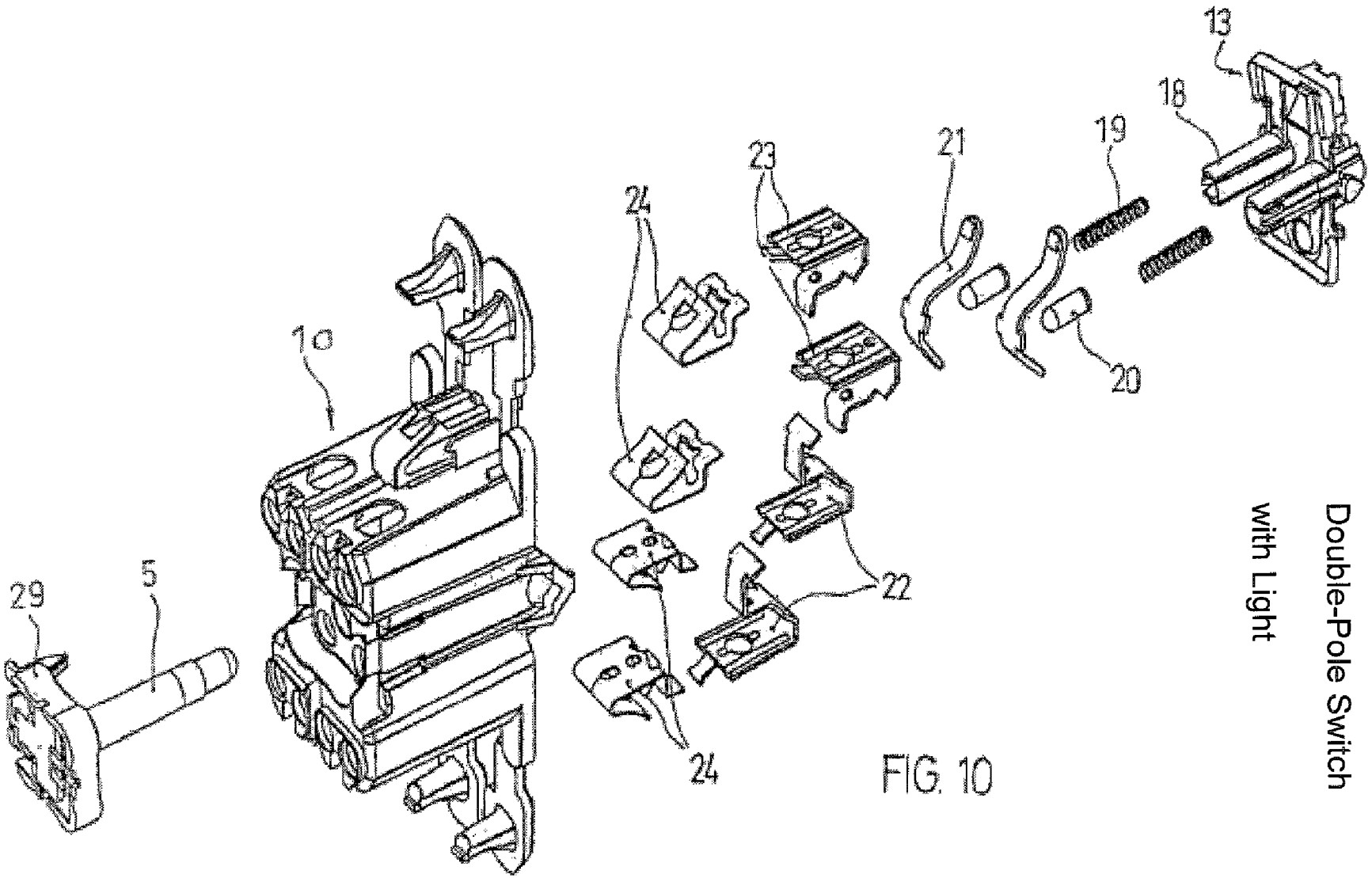
FIG. 10 portrays an exploded view in perspective of the mechanism in its configuration of the double-pole switch with pilot-light.
Figure 11:
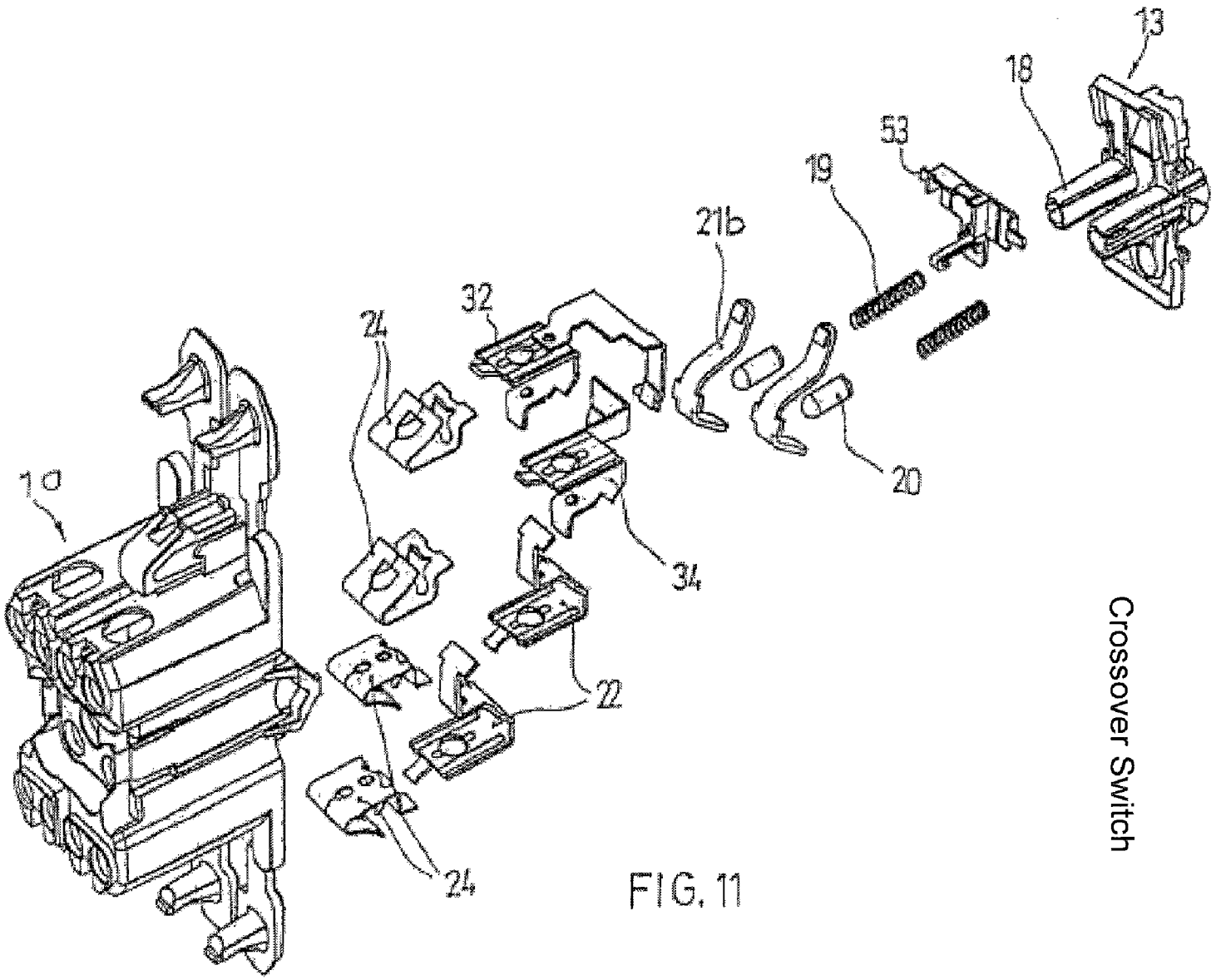
FIG. 11 portrays an exploded view in perspective of the mechanism in its configuration of the crossover switch.

The contacts for the configuration of the mechanism as a double-pole switch with pilot light, as portrayed in FIG. 10, are identical to those of the previous configuration: two swinging contacts (21), two contact bases (22); two closing-contacts (23) and four connection contacts (24), together with the respective cylindrical lugs (20), and their springs (19), but adding the lamp (5) on its base (29), whose contacts will be arranged for its operation as a pilot light.

The mechanism, in its configuration as a crossover switch, as portrayed in FIGS. 11, 35 to 38, is equipped with two swinging contacts (21*b*), equipped at one of their ends with two contact buttons (25), likewise their respective contact bases (22) and a closing contact (32) equipped with a long upper flange (33) for the function of changeover or two-way switching, and a second closing contact (34), equipped in turn 35 with a changeover flange (35), similar to the one mentioned above, being rounded off with four connection contacts (24).

The manufacture of the closing contact (32) with its upper flange (33) should be highlighted, made by means of the joining of its various elements by soldering, a more advantageous manufacturing process than the currently known process of riveting.

Figure 12:
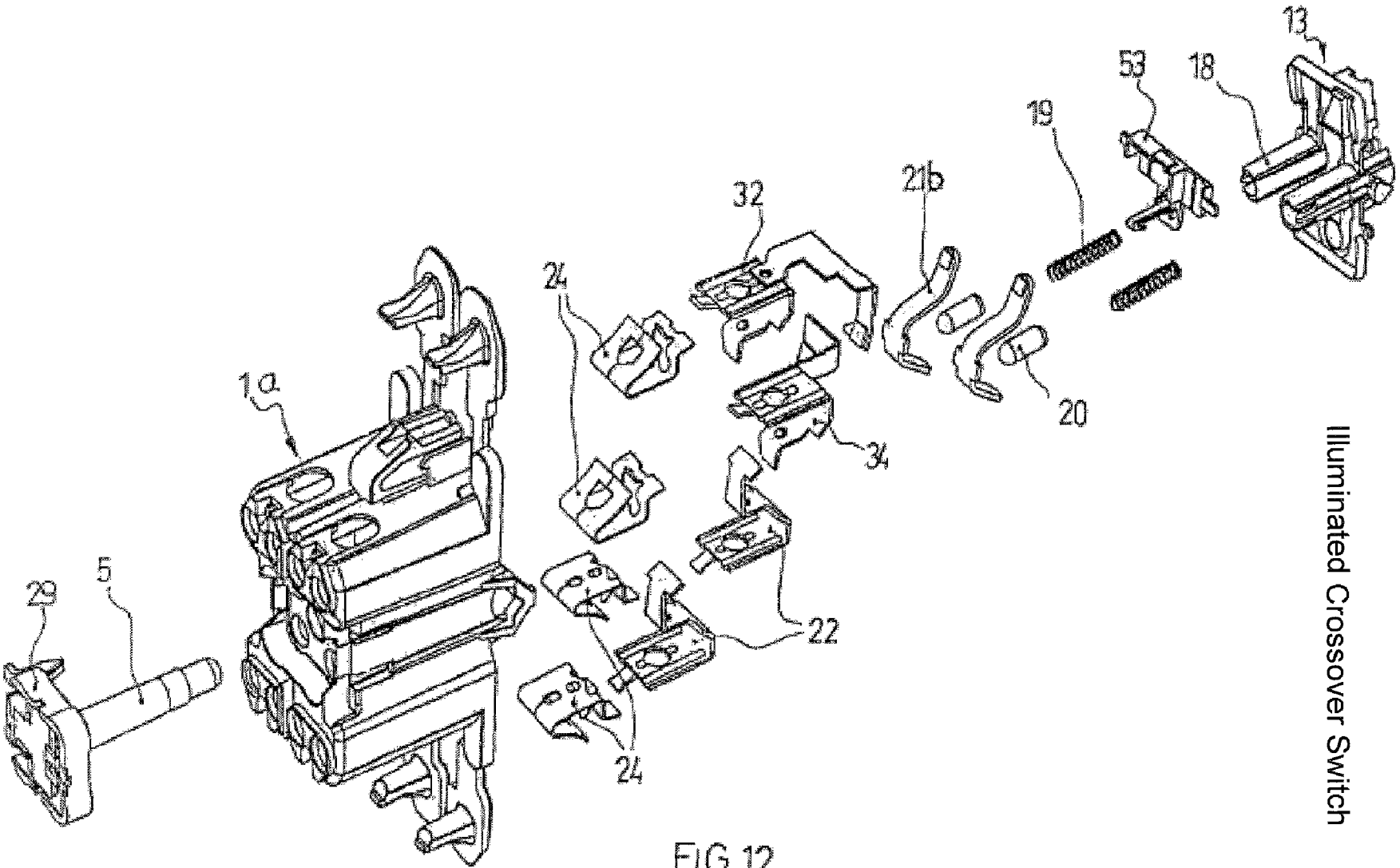
FIG. 12 portrays an exploded view in perspective of the mechanism in its configuration of the illuminated crossover switch.
Figure 13:
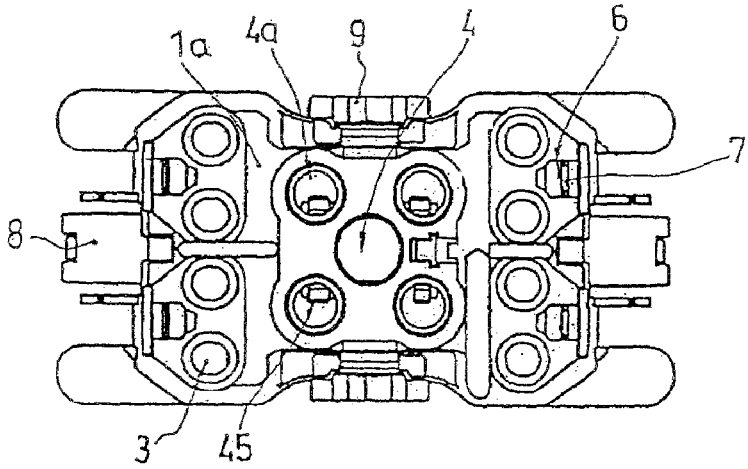
FIG. 13 is a plan view of the back of a casing with four mounts.
Figure 14:
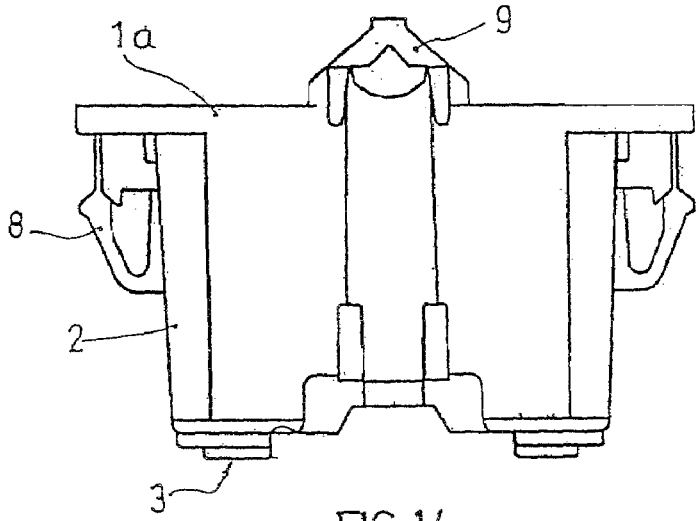
FIG. 14 is an elevational view of the same casing, from the front.
Figure 15:
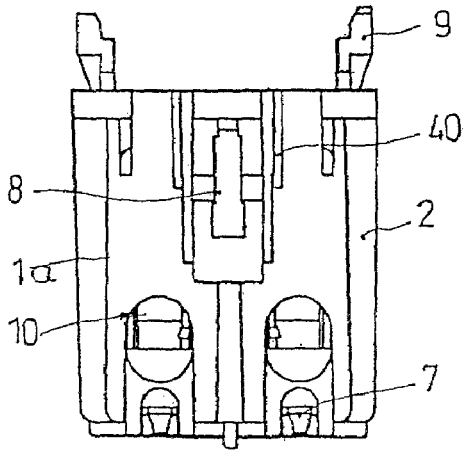
FIG. 15 is a view of the casing in FIG. 13, seen from the side.
Figure 16:
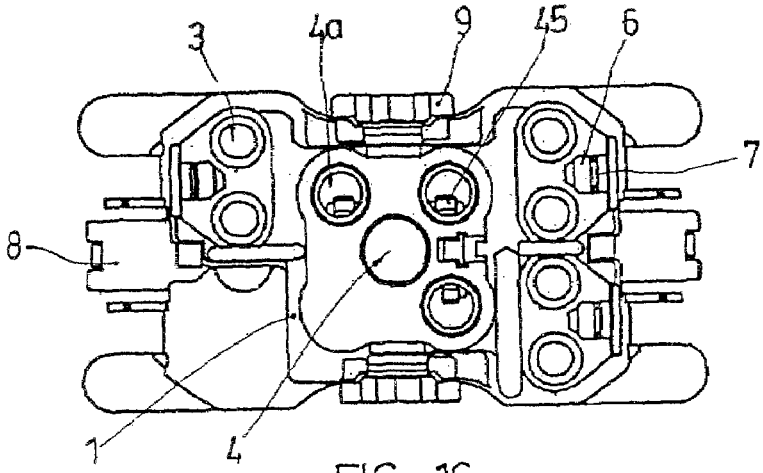
FIG. 16 is a plan view of the back of a casing with three mounts.
Figure 17:
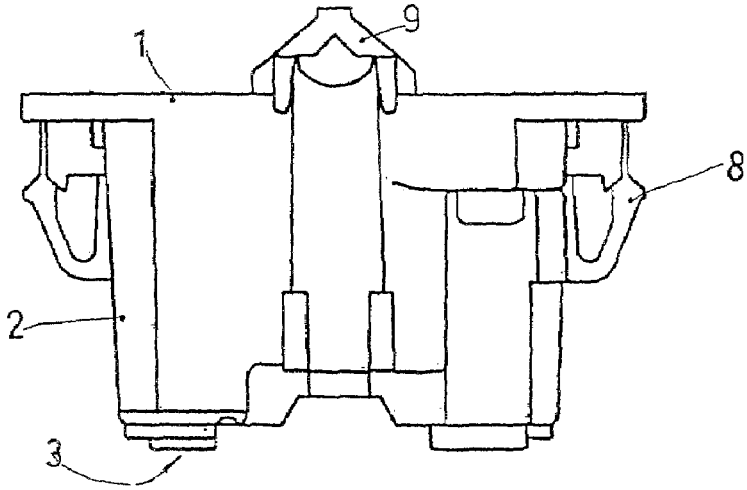
FIG. 17 is an elevational view of the same casing, from the front.
Figure 18:
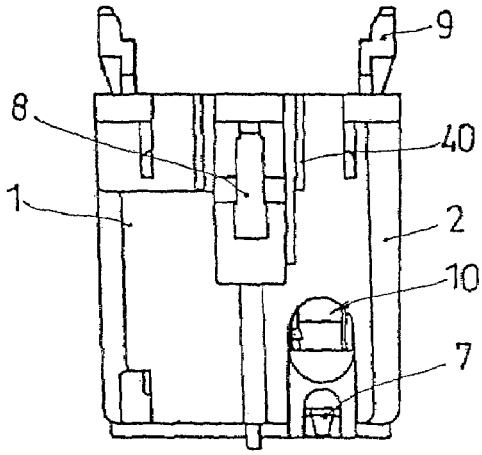
FIG. 18 is an elevational view of the side of the casing in FIG. 16.
Figure 19:
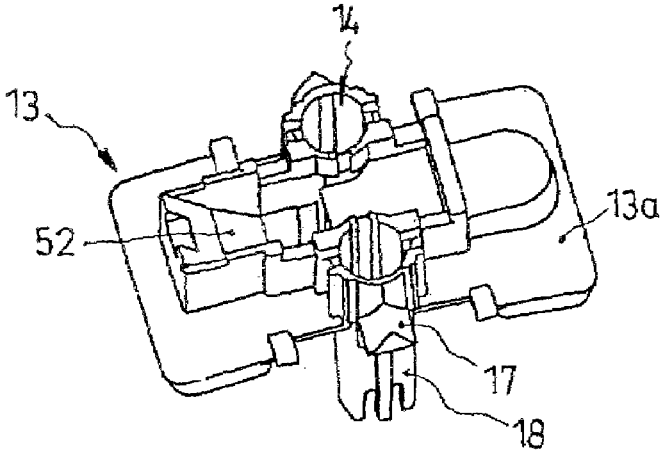
FIG. 19 is a view of the rocker which corresponds to a casing with four mounts, seen from above and in perspective.
Figure 20:
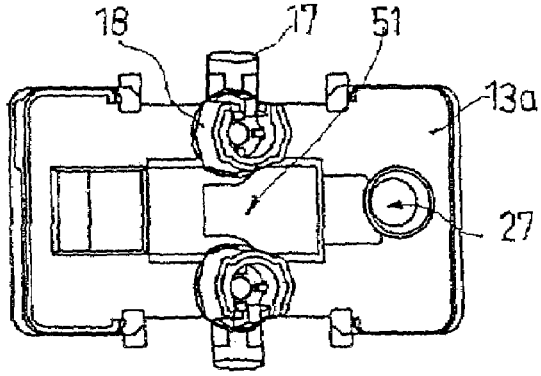
FIG. 20 is a plan view of the lower part of the same rocker.
Figure 21:
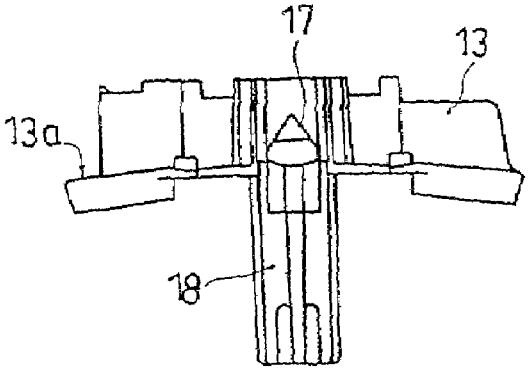
FIG. 21 is a front elevational view of the rocker in the previous figure.
Figure 22:
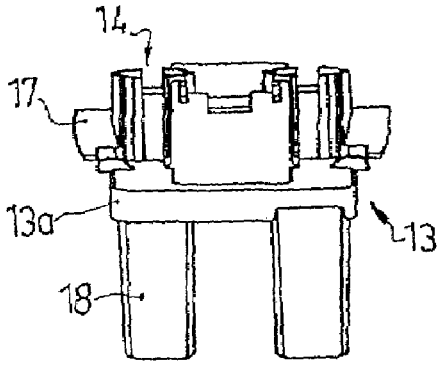
FIG. 22 is a side elevational view of the same rocker.
Figure 23:
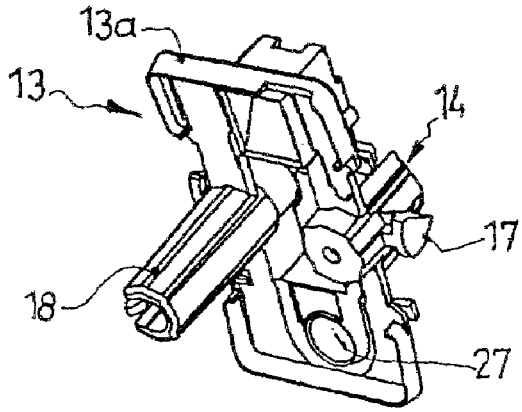
FIG. 23 is a view, seen from below and in perspective, of the rocker which corresponds to a casing with three mounts.
Figure 24:
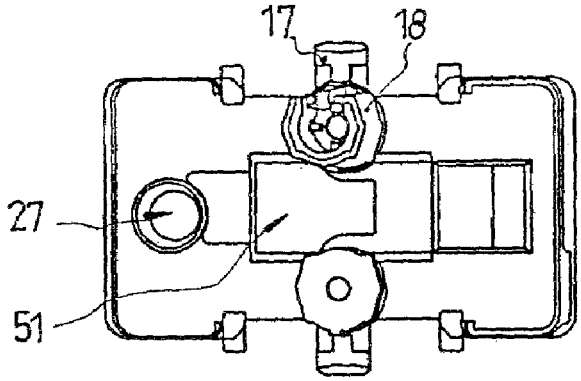
FIG. 24 is a plan view of the lower part of the same rocker.
Figure 25:
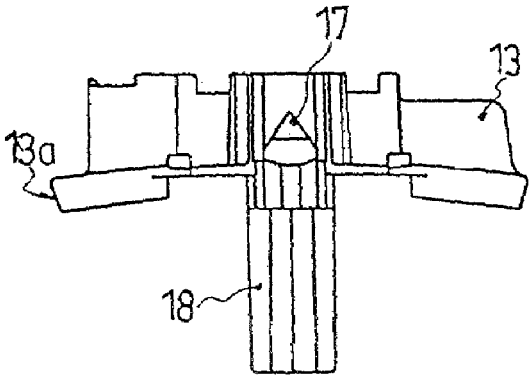
FIG. 25 is a front elevational view of the rocker in the previous figure.
Figure 26:
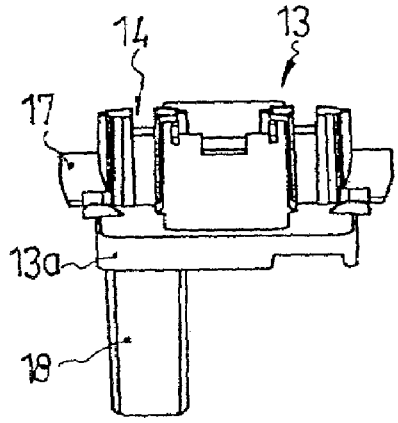
FIG. 26 is a side elevational view of the same rocker.
Figure 37:
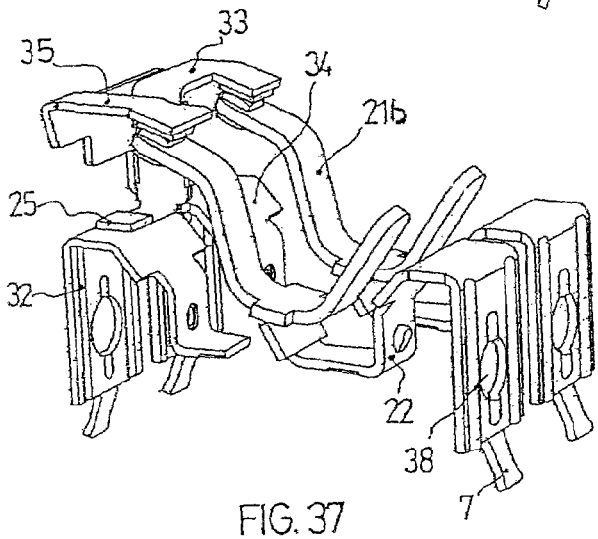
FIG. 37 is a view in perspective of said contacts, in the position portrayed in the previous figure.
Figure 38:
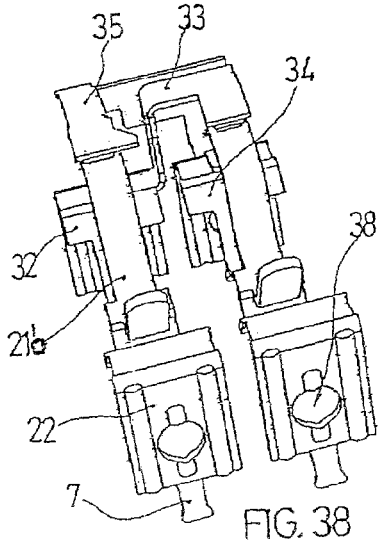
FIG. 38 is another view in perspective, from a different viewpoint, of the set of contacts in the two previous figures.
Figure 39:
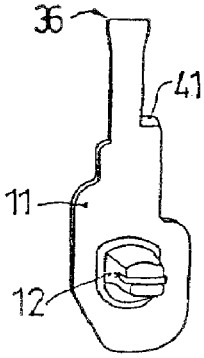
FIG. 39 is a view in perspective, from the front, of a fast connection key in its embodiment of the complete key.
Figure 40:
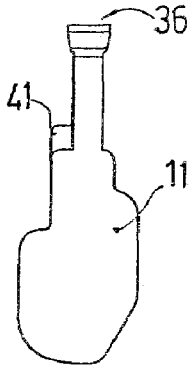
FIG. 40 is a view of the key in the previous figure, from the rear.
Figure 41:
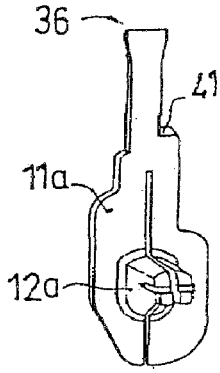
FIG. 41 is a view in perspective, from the front, of the key in its embodiment of the split key.
Figure 42:
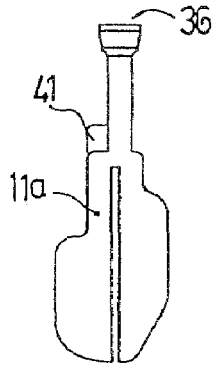
FIG. 42 is a view of the key in the previous figure, seen from the rear.
Figure 43:
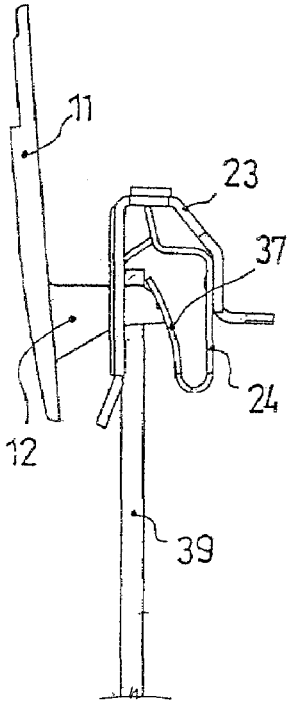
FIG. 43 is a detail, seen in profile, of the complete key, pressing on the contact for connection of a cable.
Figure 44:
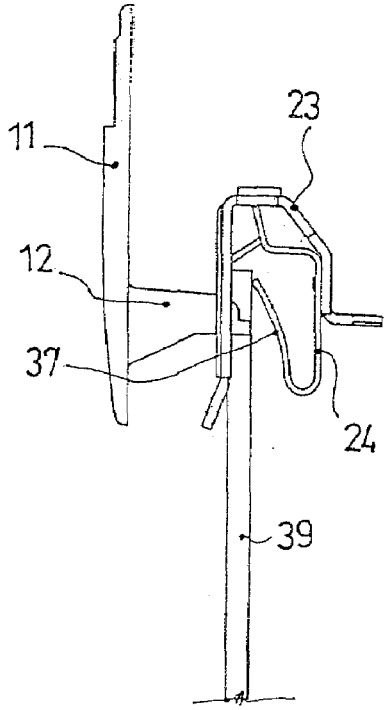
FIG. 44 is a view which is complementary to the previous figure, when the key is not pressing the contact, and the cable is connected.
Figure 45:
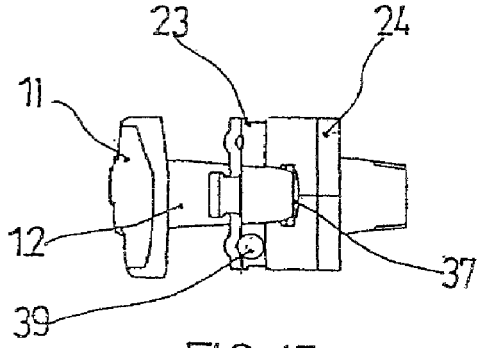
FIG. 45 is a plan view of the combination of the two previous figures, with one key pressing on the connection contact in order to connect a cable, as in FIG. 43, seen from below.
Figure 46:
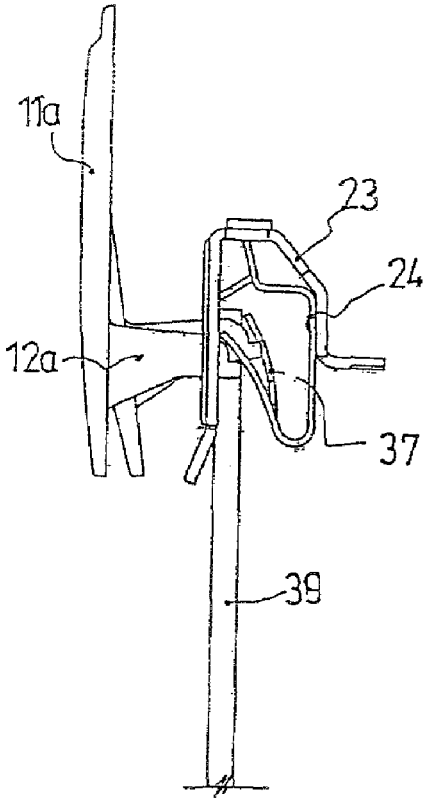
FIG. 46 is a detail, seen in profile, of the split key, pressing on the contact for connection of a cable.
Figure 47:
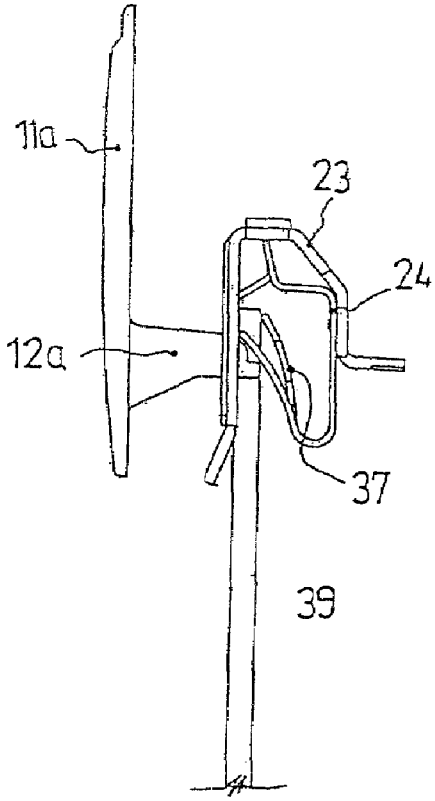
FIG. 47 is a view which is complementary to the previous figure, when the split key is not pressing the contact, as the cable is connected.
Figure 48:
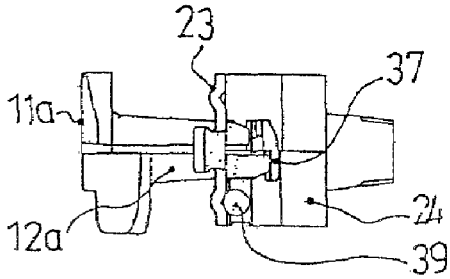
FIG. 48 is a plan view of the combination of the two previous figures, with one key pressing on the connection contact in order to connect a cable, as in FIG. 46, seen from below.
Figure 49:
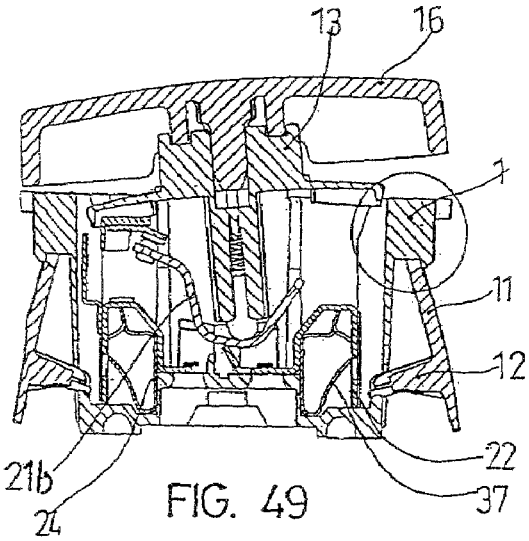
FIG. 49 is a sectional view of a mechanism, showing the locking of the connection key by means of a protruding rib of the casing.
Figure 50:
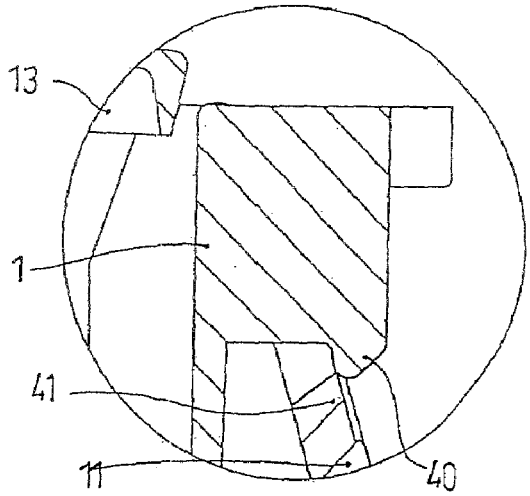
FIG. 50 is a larger-scale detail of the point of the locking rib shown in the previous figure.
Figure 51:
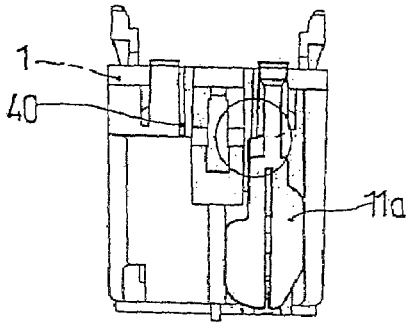
FIG. 51 is a side elevational view of a key placed in its position on the side of the casing, showing the key locking rib at the edge of the casing.
Figure 52:
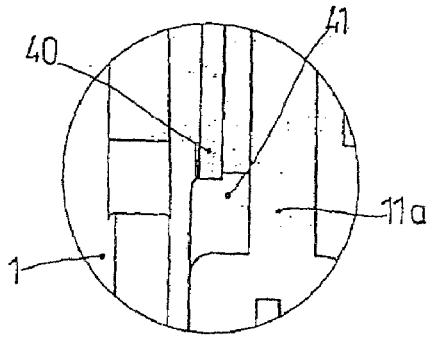
FIG. 52 is a larger-scale detail of the locking position shown in the previous figure.
Figure 53:
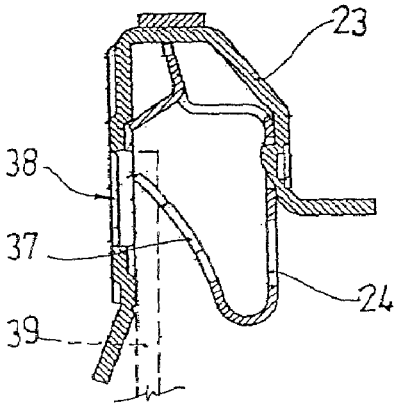
FIG. 53 is a cross-sectional detail of the joint of the contact spring.
Figure 54:
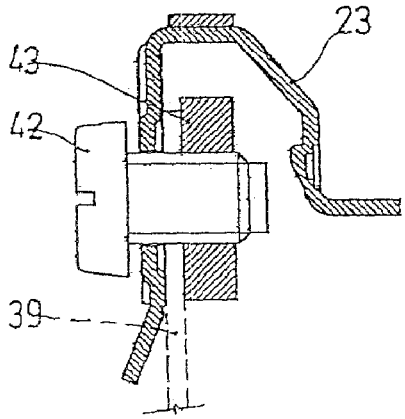
FIG. 54 is a cross-sectional detail of the joint of the contact screw.
Figure 55:
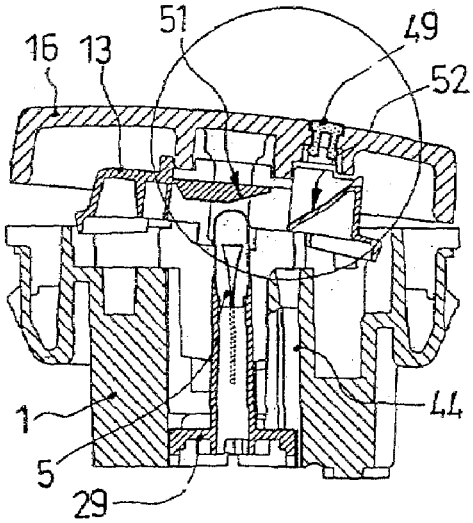
FIG. 55 is a cross-section of a mechanism, at its centre, showing the location of the reflector of the light generated by the lamp.
Figure 56:
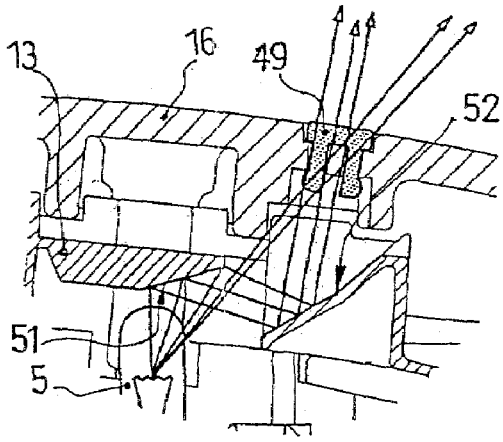
FIG. 56 is a larger-scale detail of the emergence of the light through the visor in the key.
Figure 57:
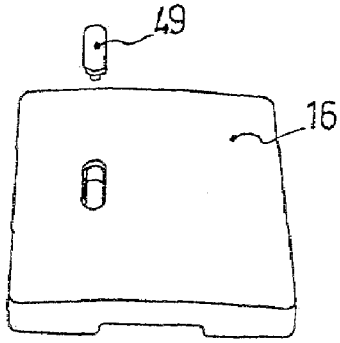
FIG. 57 portrays the key in perspective, and in exploded view, with the visor set to one side of the central axis.
Figure 58:
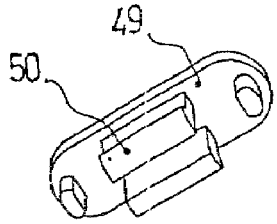
FIG. 58 is a view in perspective of the visor, from its underside, showing the locking tabs.
Figure 59:
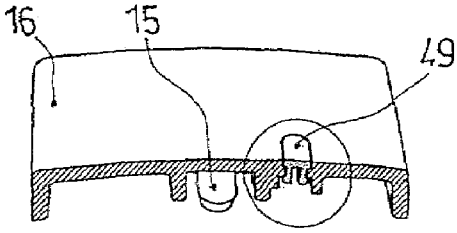
FIG. 59 is a cross-sectional view in perspective of the key, with the visor in place; the cross-section made on the central plane.
Figure 60:
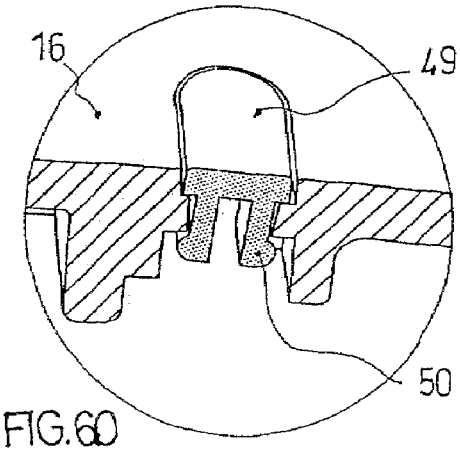
FIG. 60 is a larger-scale detail of the previous figure, where the positioning and the locking of the visor in the key may be observed.
Figure 61:
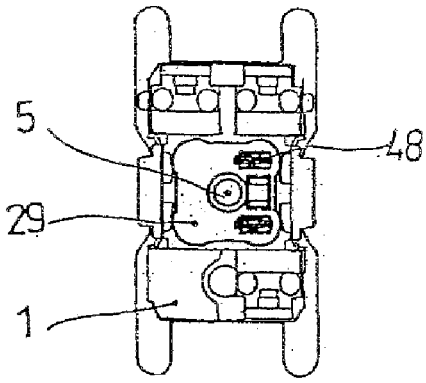
FIGS. 61 to 65 are a series of details regarding the location of the pilot light in the different configurations, in plan view.
Figure 62:
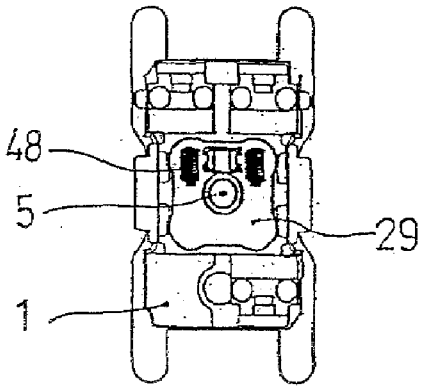
Figure 63:
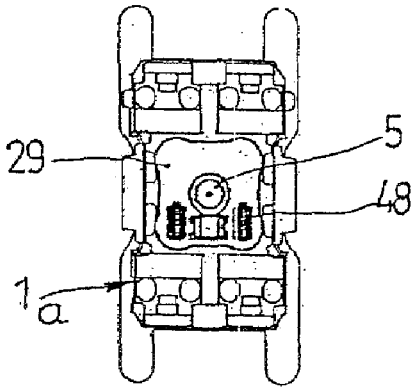
Figure 64:
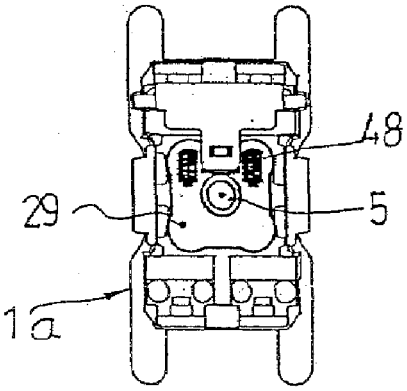
Figure 65:
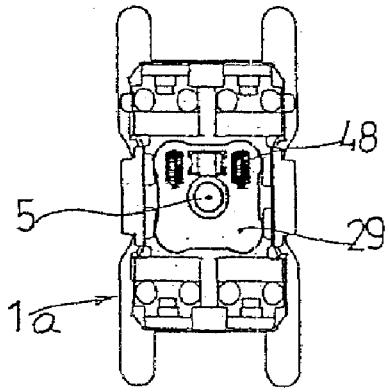

The configuration which complements the one above, that of illuminated crossover switch, in accordance with FIGS. 12 and 37 to 38, adds to the contacts mentioned the lamp (5) installed on its base (29), its contacts being arranged for operation as a pilot light.

As has been mentioned above, when describing the casing (1), this casing presents on its upper surface the fast connection keys (11) which, at the moment of installing the mechanism, will be positioned in their operating position, being bent downwards approximately 90°, due to the narrowing or neck (36) which it features at its upper part. Once the key is in position, it will be opposite the lateral opening (10) in the casing (1), in such a way that the protruding lug (12) on the key (11) will be inserted through said opening (10) until it bears against the two spring-clips (37) of the connection contact (24), said lug passing through the lateral orifice (38) with which the closing contact (23) is provided to this end.

The assembly is thus prepared in order that on exerting an inward pressure from the exterior on the key (11), the latter, due to the action of the lug (12) will move the two spring-clips (37), separating them from their initial position, allowing the positioning of the cable or electrical wire (39) to be connected. On releasing the pressure on the key (11), the spring-clip (37) will return to its initial position, pressing against the cable (39), which will be immediately connected.

In a variation of the application, this connection key will be split at its lower central area (11*a*), the protruding lug (12*a*) also being split, in order that pressure may be exerted independently on these two adjacent spring-clips (37) of the connection contacts (24); all of these being adapted to the particular structure of the split key (11*a*).

When the keys (11) and (11*a*) have been bent and positioned, a safety element will prevent them from accidentally returning to their undesired initial position: the casing (1) possesses a rib (40) on the internal surface of its, upper edge under which, as may be seen in FIGS. 49 to 52, the key (11)/(11*a*) will be imprisoned as the upper lateral projection (41) of the key becomes locked in this position, once bent at its neck (36).

Another characteristic of this invention is the method by which the contact bases (22) and the closing contacts (23), in their different forms, are positioned and fixed to the inside of the casing (1).

The lower end of these contacts is equipped with a dovetail-shaped flange (7) which, at the moment of assembling the contacts in their location, is placed through the opening (6) at the side of the base of the casing (1). At this moment, and by means of a mechanized process, said flange (7) is automatically bent upwards, thus holding fast to its surroundings (position 7*a*), preventing the contact from moving.

Figure 71:
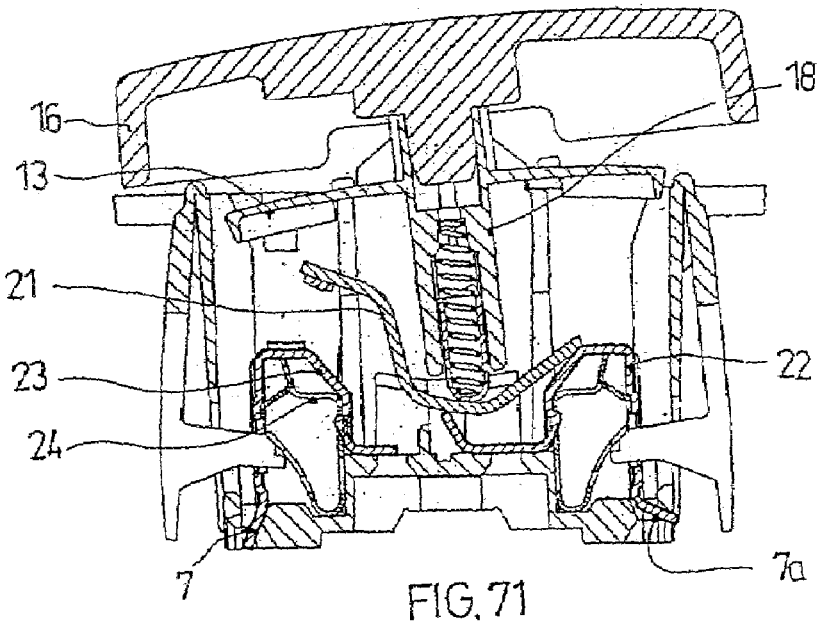
FIG. 71 is a cross-section of a mechanism, showing the detail of the dovetail shape of the contacts, one of these being in the position of assembly, and the other already bent, in order to guarantee a firm hold.
Figure 72:
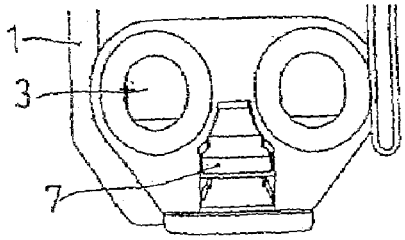
FIG. 72 is a larger-scale detail of the dovetail set in the base of the casing, seen from below, in the position for positioning and assembly.
Figure 73:
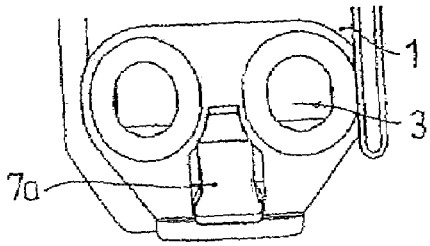
FIG. 73 is a view, corresponding totally to the previous figure, but with the dovetail bent into the locking position.
Figure 74:
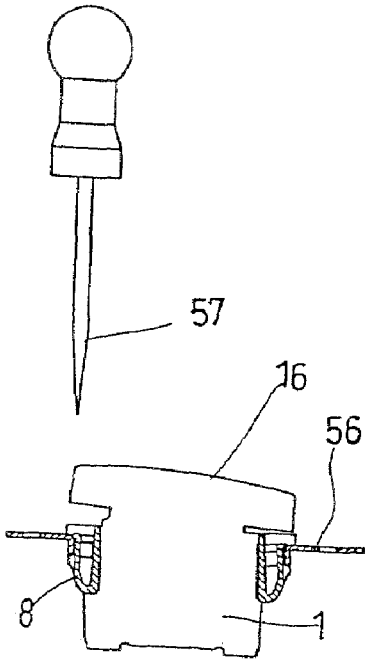
FIGS. 74 to 86 present the sequence of the operation for extracting the main part of the mechanism from the front, without any need to dismantle any fixing element, such as the supporting ring.
Figure 75:
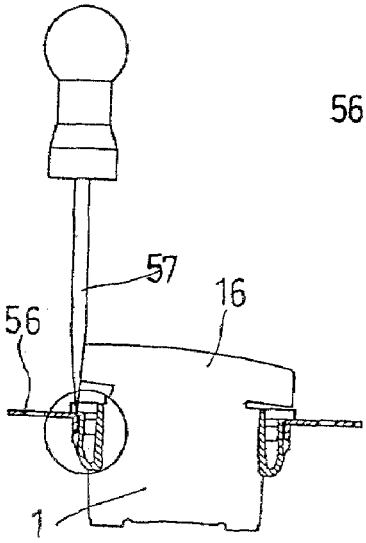
Figure 76:
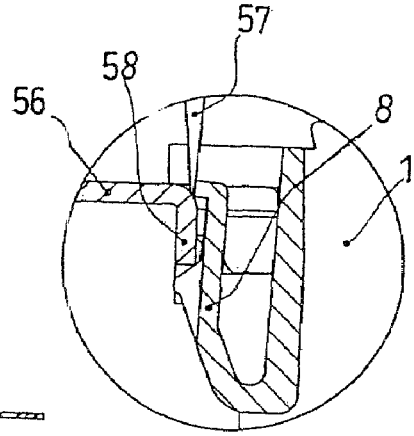
Figure 77:
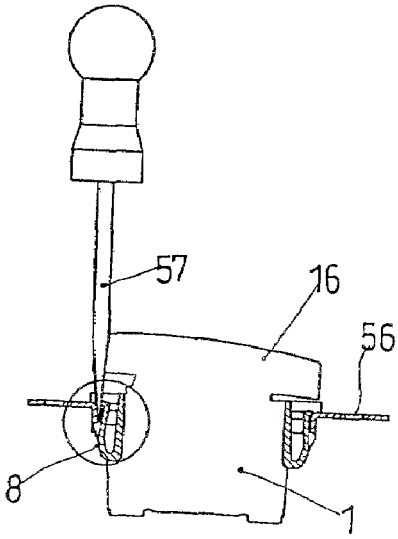
Figure 78:
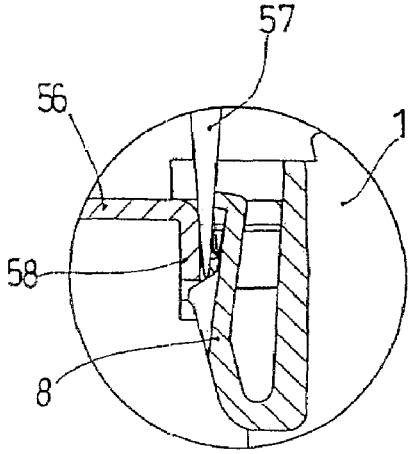
Figure 79:
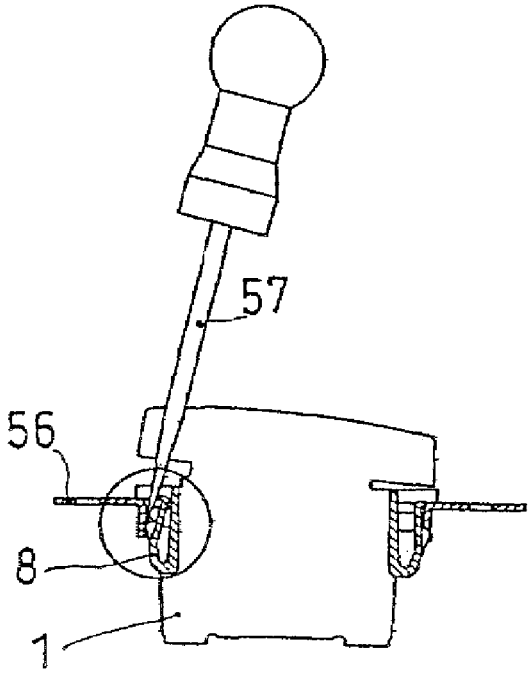
Figure 80:
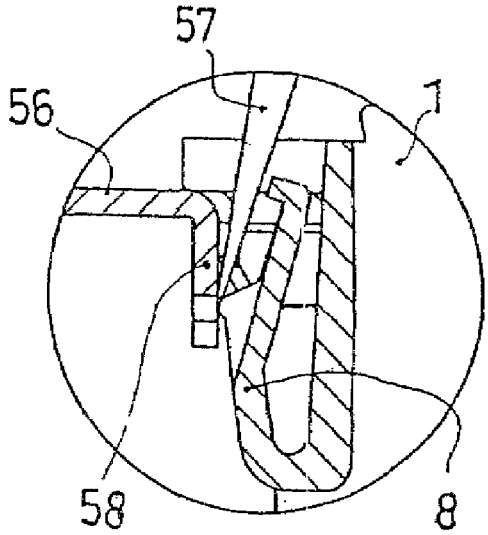
Figure 81:
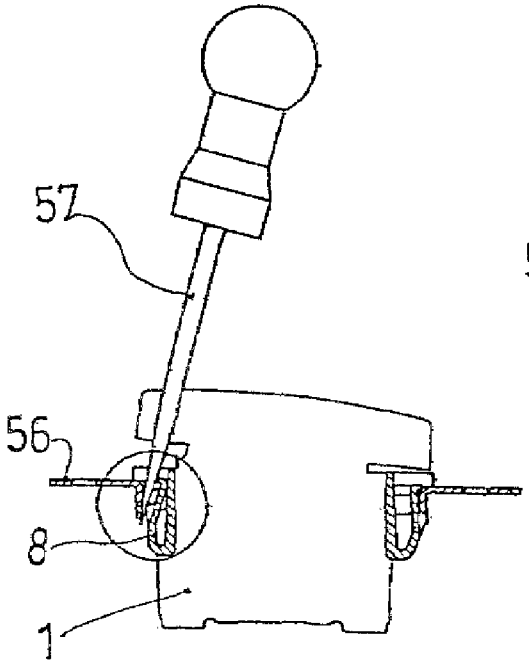
Figure 82:
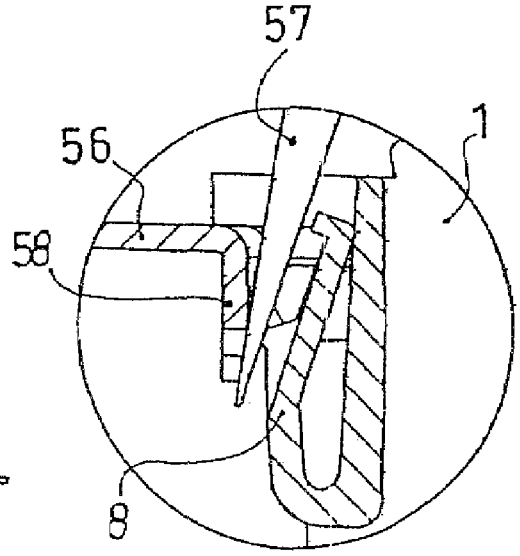
Figure 83:
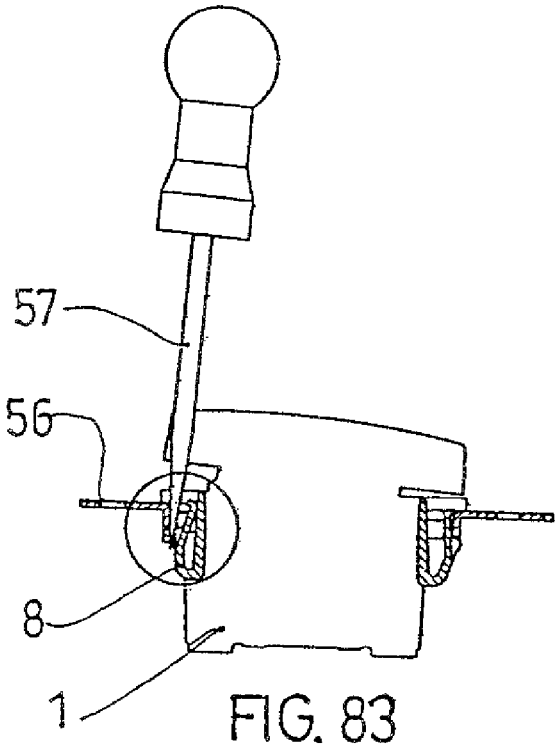
Figure 84:
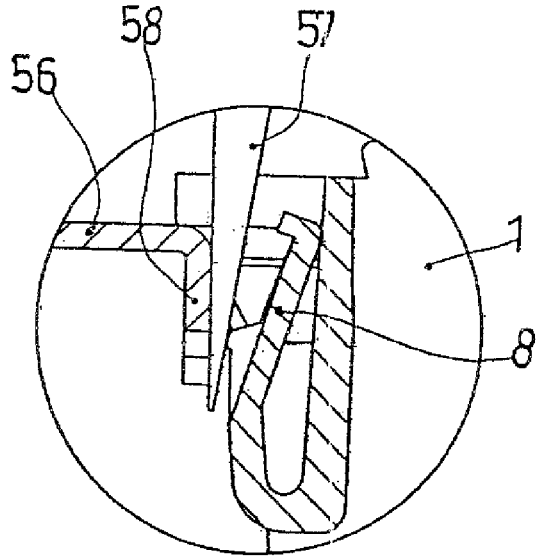
Figure 85:
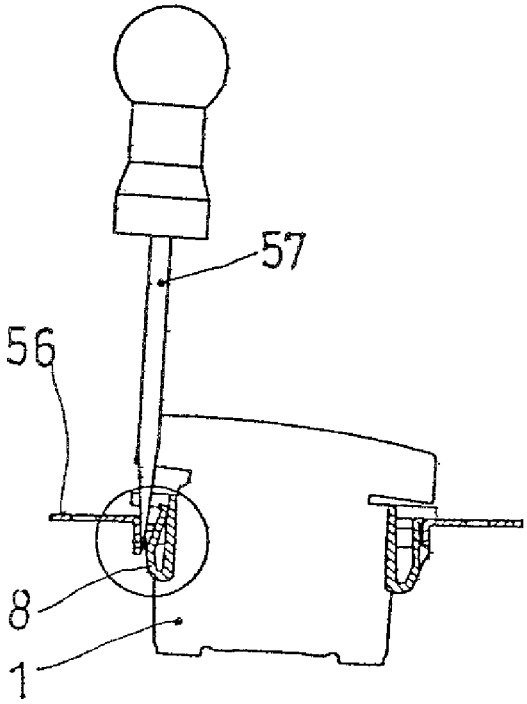
Figure 86:
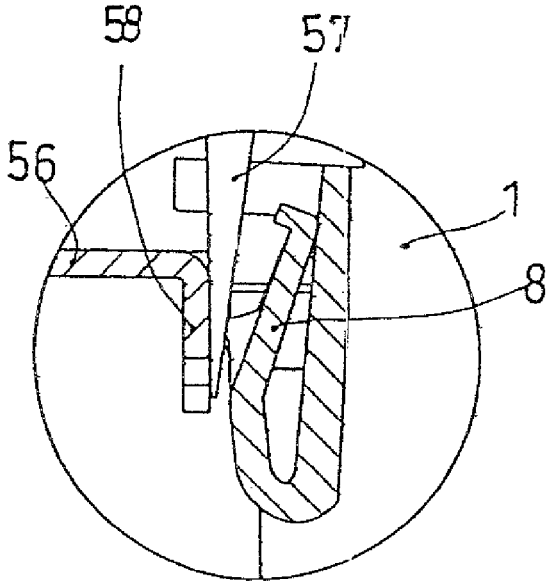

In FIGS. 71 to 73, this process and the action of fixing and locking by means of the dovetail-shaped flanges (7) is portrayed.

Likewise, in the central part (44) of the casing (1), in the lower area, some lugs (45) with an inclined triangular profile and a quadrangular base are located, as may be seen in FIGS. 67 to 70.

The lower horizontal section (46) of the contact base (22) and the lower horizontal section of the closing contact (23), and of their variants, are positioned under these lugs (45), said contacts thus being immovably fixed.

In several of its configurations, the mechanism shall be equipped with the lamp (5), for the purpose of illumination or pilot light.

The contacts (48) of the base (29), as has been mentioned repeatedly above, will be positioned differently, in accordance with the function desired, turning the base through 90° and making contact with different contacts inside the casing (1), as portrayed in FIGS. 60 to 65, in order to function as illumination or as a pilot light, as required by the different configurations.

Regarding the viewing from the exterior of the mechanism of the light produced by the lamp (5), said light will be visible through the visor (49) located on the external surface of the external key (16), into which it is pressed and is affixed by means of its locking tabs (50).

The visor (49) is not central, with regard to the to axes of symmetry of the key, but is slightly offset.

For this reason, and so that the light may be visible from the exterior, the rocker (13) is provided, at the centre of the lower surface of its plate (13*a*), with a sloping wall (51), with a polished surface, complemented by another sloping wall (52), likewise polished, located below the position occupied by the visor (49) in the external key (16). Part of the light coming from the lamp (5) will be twice reflected by the two aforementioned sloping surfaces (51) and (52), to bear directly on the visor (49), while the remainder of the light will do so directly, by which means it will be sufficiently visible from the exterior.

These two sloping surfaces (51) and (52) are at the same time protective safety elements, as they prevent accidental direct access to the interior of the casing (1) of the mechanism, and to the contacts in particular.

Figure 66:
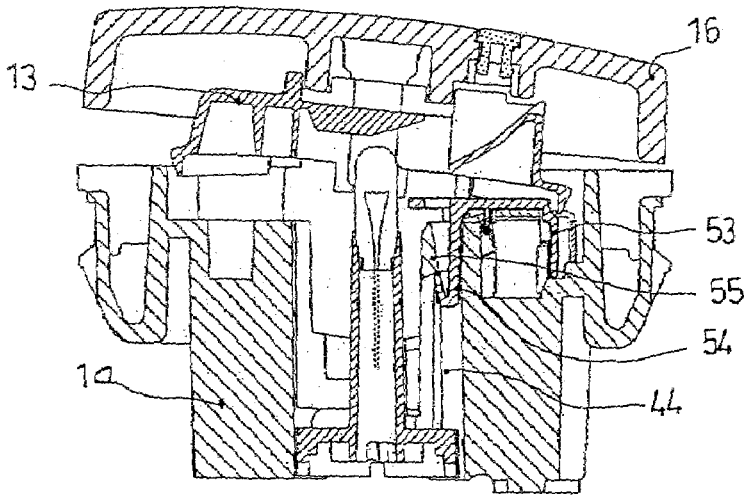
FIG. 66 is a cross-section of the mechanism, showing the separator located at the crossover contacts.
Figure 67:
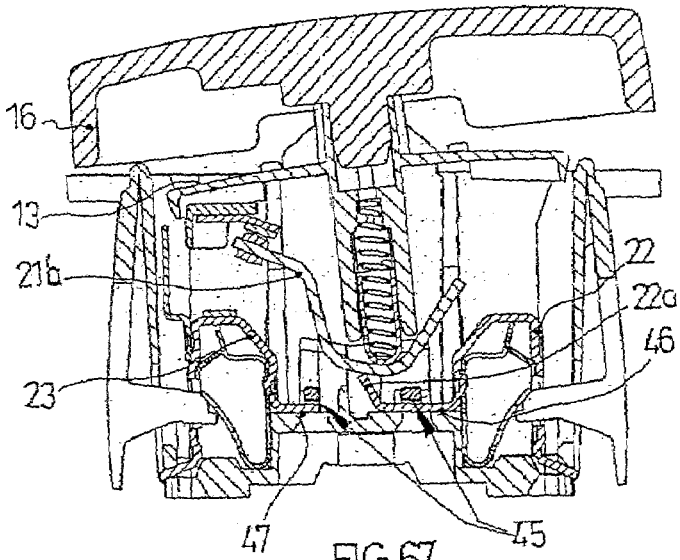
FIG. 67 is another cross-section of the mechanism, in which the contact retaining lugs in the base may be seen.
Figure 68:
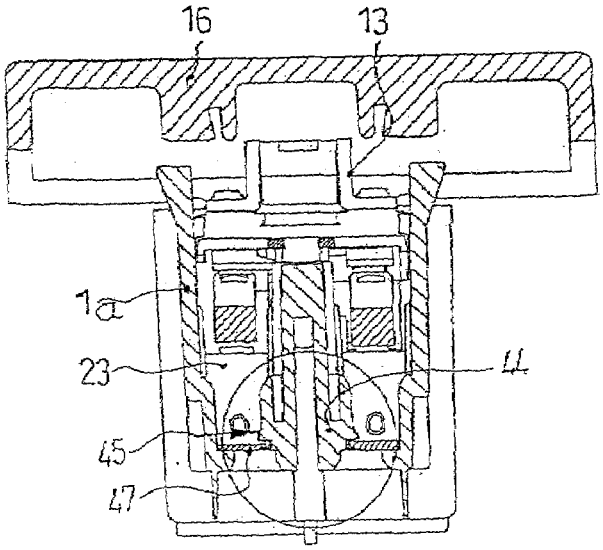
FIG. 68 is a cross-section of the same mechanism, the section being on a different plane, likewise showing the aforementioned retaining lugs.
Figure 69:
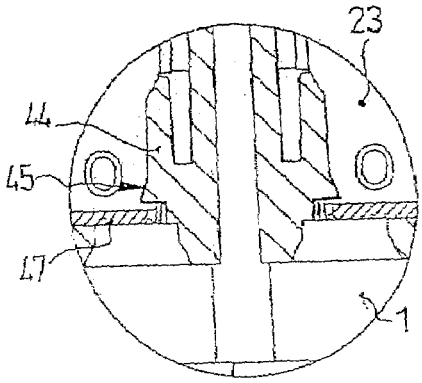
FIG. 69 is a larger-scale detail of the previous figure, in which the contact retaining lugs may be seen.
Figure 70:
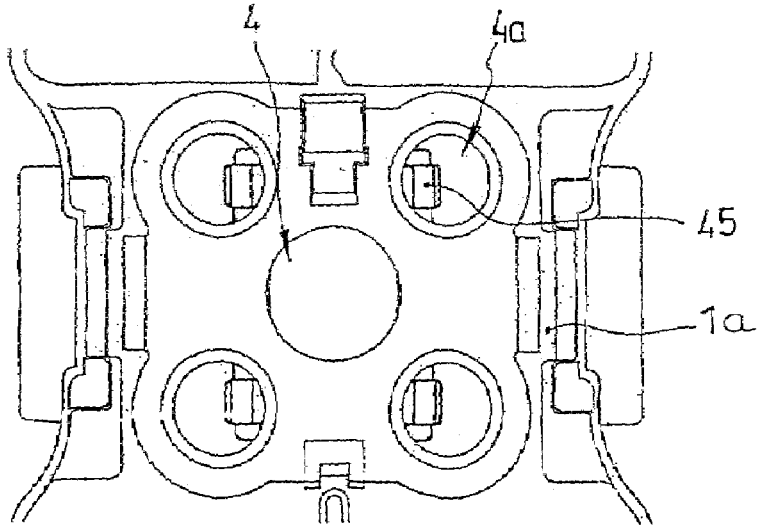
FIG. 70 is a view from below of the casing of the mechanism, in which the layout of the lugs indicated in FIGS. 67 to 69 may be noted.

The necessary fitting of another safety element should be highlighted, in the configuration of the mechanism as a crossover switch, that of the addition of a separator (53), as portrayed in FIG. 66, positioned between contacts (32) and (34), with the object of preventing electric arcing. This separator (53) is affixed by means of its lower flange (54) to the lower edge (55) of the central part (44) of the casing (1).

This casing (1), once the entirety of the mechanism has been assembled, is attached to the metallic supporting ring (56), under whose folded edge (58) the tabs (8) on the sides of the casing (1) lock.

An essential characteristic of this invention is the peculiar method of extraction from the front of the main part of the mechanism (casing 1, rocker 3 and all their components) by means of an action executed from the exterior, by means of an auxiliary tool (57), and portrayed in the sequence of FIGS. 74 to 86.

This tool (57) will release the tab (8) from its locked position under the folded edge of the metallic supporting ring (56), thus freeing all the main part of the mechanism.

As may be seen in FIG. 1, the assembly of the mechanism, surrounding the external key (16) is rounded off with the trim (16*a*) and its frame (16*b*).

The object of this patent of invention having been sufficiently disclosed, it should be indicated that any variation in dimensions, shape, finishes and types of material used in the practical embodiment of the mechanism in any of its configurations will in no way alter the essence of the patent, which is summarized in the following claims:

The invention claimed is:

1. A multi-functional, flush-fitting electrical mechanism configured to function as one of a single-pole switch, an illuminated single-pole switch, a single pole switch with pilot light, a bell-push, an illuminated bell push, a two-way switch, an illuminated two-way switch, a two-way switch with pilot light, a double-pole switch, a double-pole switch with pilot light, a crossover switch, and a crossover switch with pilot light; consisting of a body or casing held by a supporting ring and an external frame trim wherein:

the body or casing comprises a hollow interior enclosing sets of interchangeable contacts and is provided with an external operating key bearing on a rocker;

the rocker transmits an action exerted on the key to one or more swinging contacts;

in a two swinging contact embodiment, the rocker is provided with two pivots;

in a one swinging contact embodiment, the rocker is provided with a single pivot;

a visor is located in the external key and arranged to permit light to emerge through the visor;

the casing of the mechanism is removable from the front without dismantling the supporting ring;

contacts for a pilot lamp allow its function to be changed between pilot light and illumination by turning the position of the pilot lamp;

the body or casing (1*a*) is formed by a hollow block whose shape is slightly like that of a truncated pyramid, with four lateral mounts in its variant as a mechanism for housing four connections, or as a casing (1) with three mounts in its variant as a mechanism for housing two or three connections;

each of the three lateral mounts (2) has two orifices (3) for the insertion of cables to be connected; and in the casing (1), a central orifice (4) for installation of the pilot lamp (5), the openings (6) for the arrangement of the dovetail-shaped flanges (7) of the contacts, the lateral locking tabs (8), the lateral flanges for supporting the rocker (13), and the three or four orifices (10), in accordance with the number of mounts, two on each side, for an insertion of a protruding lug (12) of fast connection keys (11), keys which are initially located at a level of an upper surface of the casing (1).

2. A multi-functional, flush-fitting electrical mechanism configured to function as one of a single-pole switch, an illuminated single-pole switch, a single pole switch with pilot light, a bell-push, an illuminated bell push, a two-way switch, an illuminated two-way switch, a two-way switch with pilot light, a double-pole switch, a double-pole switch with pilot light, a crossover switch, and a crossover switch with pilot light; consisting of a body or casing held by a supporting ring and an external frame trim wherein:

the body or casing comprises a hollow interior enclosing sets of interchangeable contacts and is provided with an external operating key bearing on a rocker;

the rocker transmits an action exerted on the key to one or more swinging contacts;

in a two swinging contact embodiment, the rocker is provided with two pivots;

in a one swinging contact embodiment, the rocker is provided with a single pivot;

a visor is located in the external key and arranged to permit light to emerge through the visor;

the casing of the mechanism is removable from the front without dismantling the supporting ring;

contacts for a pilot lamp allow its function to be changed between pilot light and illumination by turning the position of the pilot lamp; and the rocker (13) is comprised of a slightly curved rectangular plate (3*a*), on whose upper surface the cavities (14) for an insertion of the locking elements (15) of the external key (16) are located, equipped with lateral rocking supports (17) and hollow pivots (18), of which there are two in the embodiments of the double-pole switch, double-pole switch with pilot light, crossover switch and illuminated crossover switch, and one in the embodiments of the single-pole switch, illuminated single-pole switch, single-pole switch with pilot light, bell-push, illuminated bell-push, two-way switch, illuminated two-way switch and two-way switch with pilot light.

3. A multi-functional, flush-fitting electrical mechanism configured to function as one of a single-pole switch, an illuminated single-pole switch, a single pole switch with pilot light, a bell-push, an illuminated bell push, a two-way switch, an illuminated two-way switch, a two-way switch with pilot light, a double-pole switch, a double-pole switch with pilot light, a crossover switch, and a crossover switch with pilot light; consisting of a body or casing held by a supporting ring and an external frame trim wherein:

the body or casing comprises a hollow interior enclosing sets of interchangeable contacts and is provided with an external operating key bearing on a rocker; p1 the rocker transmits an action exerted on the key to one or more swinging contacts;

in a two swinging contact embodiment, the rocker is provided with two pivots;

in a one swinging contact embodiment, the rocker is provided with a single pivot;

a visor is located in the external key and arranged to permit light to emerge through the visor;

the casing of the mechanism is removable from the front without dismantling the supporting ring;

contacts for a pilot lamp allow its function to be changed between pilot light and illumination by turning the position of the pilot lamp; and casing (1) houses in its interior the contacts necessary for its different configurations; In the configuration as a single-pole switch it is equipped with a swinging contact (21) which rocks on a contact base (22), and a closing contact (23), and connection contacts (24), the upper end of the swinging contact (21) and the closing contact (23) being equipped with contact buttons (25).

4. A multi-functional, flush-fitting electrical mechanism configured to function as one of a single-pole switch, an illuminated single-pole switch, a single pole switch with pilot light, a bell-push, an illuminated bell push, a two-way switch, an illuminated two-way switch, a two-way switch with pilot light, a double-pole switch, a double-pole switch with pilot light, a crossover switch, and a crossover switch with pilot light; consisting of a body or casing held by a supporting ring and an external frame trim wherein:

the body or casing comprises a hollow interior enclosing sets of interchangeable contacts and is provided with an external operating key bearing on a rocker;

the rocker transmits an action exerted on the key to one or more swinging contacts;

in a two swinging contact embodiment, the rocker is provided with two pivots;

in a one swinging contact embodiment, the rocker is provided with a single pivot;

a visor is located in the external key and arranged to permit light to emerge through the visor;

the casing of the mechanism is removable from the front without dismantling the supporting ring;

contacts for a pilot lamp allow its function to be changed between pilot light and illumination by turning the position of the pilot lamp; and in a configuration as a bell-push it is equipped with a swinging contact (21) which rests on a contact base (22), and a closing contact (23), also connection contacts (24), being equipped with a cylindrical return spring (26), whose upper end is located in a housing (27) located on a lower surface of the rocker (13), while its lower end is inserted into a orifice (28) in one side of the casing (1), in such a way that when pressure ceases to be exerted on the external key (16), the assembly returns to its initial non-activated position.

5. A multi-functional, flush-fitting electrical mechanism configured to function as one of a single-pole switch, an illuminated single-pole switch, a single pole switch with pilot light, a bell-push, an illuminated bell push, a two-way switch, an illuminated two-way switch, a two-way switch with pilot light, a double-pole switch, a double-pole switch with pilot light, a crossover switch, and a crossover switch with pilot light; consisting of a body or casing held by a supporting ring and an external frame trim wherein:

the body or casing comprises a hollow interior enclosing sets of interchangeable contacts and is provided with an external operating key bearing on a rocker;

the rocker transmits an action exerted on the key to one or more swinging contacts;

in a two swinging contact embodiment, the rocker is provided with two pivots;

in a one swinging contact embodiment, the rocker is provided with a single pivot;

a visor is located in the external key and arranged to permit light to emerge through the visor;

the casing of the mechanism is removable from the front without dismantling the supporting ring;

contacts for a pilot lamp allow its function to be changed between pilot light and illumination by turning the position of the pilot lamp; and in a configuration as an illuminated bell-push it is equipped with a swinging contact (21) a contact base (22), closing contact (23), connection contacts (24) and a cylindrical return spring (26); likewise a lamp (5) installed on its base (29), on which appropriate contacts for operation as illumination are arranged.

6. A multi-functional, flush-fitting electrical mechanism configured to function as one of a single-pole switch, an illuminated single-pole switch, a single pole switch with pilot light, a bell-push, an illuminated bell push, a two-way switch, an illuminated two-way switch, a two-way switch with pilot light, a double-pole switch, a double-pole switch with pilot light, a crossover switch, and a crossover switch with pilot light; consisting of a body or casing held by a supporting ring and an external frame trim wherein:

the body or casing comprises a hollow interior enclosing sets of interchangeable contacts and is provided with an external operating key bearing on a rocker;

the rocker transmits an action exerted on the key to one or more swinging contacts;

in a two swinging contact embodiment, the rocker is provided with two pivots;

in a one swinging contact embodiment, the rocker is provided with a single pivot;

a visor is located in the external key and arranged to permit light to emerge through the visor;

the casing of the mechanism is removable from the front without dismantling the supporting ring;

contacts for a pilot lamp allow its function to be changed between pilot light and illumination by turning the position of the pilot lamp; and in a configuration as an illuminated single-pole switch it is equipped with a swinging contact (21) a contact base (22), a closing contact (23), and connection contacts (24), likewise a lamp (5) installed on its base (29), equipped with appropriate contacts for operation as illumination.

7. A multi-functional, flush-fitting electrical mechanism configured to function as one of a single-pole switch, an illuminated single-pole switch, a single pole switch with pilot light, a bell-push, an illuminated bell push, a two-way switch, an illuminated two-way switch, a two-way switch with pilot light, a double-pole switch, a double-pole switch with pilot light, a crossover switch, and a crossover switch with pilot light; consisting of a body or casing held by a supporting ring and an external frame trim wherein:

the body or casing comprises a hollow interior enclosing sets of interchangeable contacts and is provided with an external operating key bearing on a rocker;

the rocker transmits an action exerted on the key to one or more swinging contacts;

in a two swinging contact embodiment, the rocker is provided with two pivots;

in a one swinging contact embodiment, the rocker is provided with a single pivot;

a visor is located in the external key and arranged to permit light to emerge through the visor;

the casing of the mechanism is removable from the front without dismantling the supporting ring;

contacts for a pilot lamp allow its function to be changed between pilot light and illumination by turning the position of the pilot lamp; and in a configuration as a single-pole switch with pilot light it is equipped with a swinging contact (21), a contact base (22) a closing contact (23), and connection contacts (24), and in addition, a second closing contact (23) and its corresponding connection contact (24) for connection of the lamp (5) installed on its base (29), equipped with appropriate contacts for operation as a pilot light.

* * * * *